US011076690B2

(12) United States Patent
Sudds et al.

(10) Patent No.: US 11,076,690 B2
(45) Date of Patent: Aug. 3, 2021

(54) SHELVING DISPLAY SYSTEM

(71) Applicant: WM. WRIGLEY JR. COMPANY, Chicago, IL (US)

(72) Inventors: Edwin Sudds, Slough (GB); Jerome Morgen, Slough (GB); Jakob Loeschke, Munich (DE)

(73) Assignee: WM. WRIGLEY JR. COMPANY, Chicago, IL (US)

( * ) Notice: Subject to any disclaimer, the term of this patent is extended or adjusted under 35 U.S.C. 154(b) by 0 days.

(21) Appl. No.: 16/477,624

(22) PCT Filed: Jan. 30, 2018

(86) PCT No.: PCT/US2018/015822
§ 371 (c)(1),
(2) Date: Jul. 12, 2019

(87) PCT Pub. No.: WO2018/140906
PCT Pub. Date: Aug. 2, 2018

(65) Prior Publication Data

US 2019/0357699 A1 Nov. 28, 2019

Related U.S. Application Data

(60) Provisional application No. 62/452,080, filed on Jan. 30, 2017.

(51) Int. Cl.
*A47B 47/00* (2006.01)
*A47B 47/04* (2006.01)

(52) U.S. Cl.
CPC ..... *A47B 47/00* (2013.01); *A47B 47/047* (2013.01)

(58) Field of Classification Search
CPC ... A47B 47/00; A47B 57/04; A47B 2009/003; A47B 87/0215; A47B 87/0246;
(Continued)

(56) References Cited

U.S. PATENT DOCUMENTS 291,030 A * 1/1884 Clapper ..... A47B 57/04 108/1
460,748 A * 10/1891 Hartmann ..... A47B 7/02 108/91

(Continued)

FOREIGN PATENT DOCUMENTS

EP 0658326 A1 * 6/1995 ..... A47B 88/60

*Primary Examiner* — Jonathan Liu
*Assistant Examiner* — Devin K Barnett

(57) ABSTRACT

A shelving display system including a first shelf with left and right end portions is disclosed. The left and right end portions engage with left and right endcaps, each including a support structure for the left and right end portions of the shelf. The support structures may include slot recesses, each including a first and second slanted portion one of which engages an end portion of the shelf. The endcaps may include complementary protrusions and grooves configured for slideable engagement with one another such that the endcaps form a stacked configuration. The protrusions may include first and second tongues constructed and dimensioned such that during an assembly step when the protrusions are advanced through the complementary grooves, the first and second tongues deflect from a resting configuration to an assembled configuration. The endcaps may include an interlocking mechanism. The endcaps may have an alignment system including rails and depressions.

24 Claims, 17 Drawing Sheets

(58) Field of Classification Search
CPC ..... A47B 87/0253; A47B 57/00; A47B 87/02; A47B 87/00; A47B 87/0207; A47B 47/047; A47B 47/0066
See application file for complete search history.

(56) References Cited

U.S. PATENT DOCUMENTS 687,740 A * 12/1901 French ..... A47B 87/02 312/108
1,557,332 A * 10/1925 Robbins ..... G09F 1/04 40/312
1,589,198 A 6/1926 McComb
1,833,081 A * 11/1931 Kilmer ..... B65D 25/06 217/36
2,217,890 A * 10/1940 Cohen ..... A47B 46/00 312/312
2,647,641 A * 8/1953 Tritt ..... A47K 10/10 211/88.04
3,120,199 A * 2/1964 Kolster ..... A47B 57/04 108/6
3,145,851 A * 8/1964 Magers ..... A47F 7/144 211/186
3,149,727 A * 9/1964 Magers ..... A47F 7/144 211/186
D201,808 S * 8/1965 Yamasaki ..... D6/705
3,223,246 A * 12/1965 Daitch ..... A47B 47/00 211/134
3,549,019 A * 12/1970 Kahler ..... A47F 5/116 211/135
3,974,917 A * 8/1976 Waxmanski ..... A47F 7/08 211/36
4,074,810 A * 2/1978 Juergens ..... B42F 7/12 211/11
4,153,311 A * 5/1979 Takahashi ..... A47B 47/042 312/107
4,192,562 A * 3/1980 Bishoff ..... A47B 87/02 211/189
D254,887 S * 5/1980 Jorda-Segui ..... D6/675.1
4,236,460 A * 12/1980 Poupko ..... A47B 43/00 108/162
4,441,615 A * 4/1984 Goodrich ..... B65D 21/041 206/505
4,463,684 A * 8/1984 Klungle ..... A47B 43/00 108/91
4,600,103 A * 7/1986 Tabler ..... B65D 21/041 206/505
4,646,922 A * 3/1987 Smith ..... A47F 5/116 211/186
4,761,079 A * 8/1988 Wolske ..... B65D 33/30 383/62
4,852,749 A * 8/1989 Fernandez ..... A47J 36/24 211/126.2
D321,615 S * 11/1991 Lavine ..... D6/675.1
5,085,155 A * 2/1992 Ballard ..... A47B 47/00 108/184
5,127,340 A * 7/1992 Maro ..... A47B 57/00 108/107
D337,673 S * 7/1993 Goetz ..... D6/675.4
5,368,380 A 11/1994 Mottmiller et al.
5,415,297 A * 5/1995 Klein ..... A47B 81/068 108/61
5,492,399 A * 2/1996 Tillack ..... A47B 87/0253 108/91
D371,471 S * 7/1996 Sloan ..... D6/678.3
5,582,306 A * 12/1996 Balter ..... A47B 61/00 211/105.1
5,632,390 A * 5/1997 Podergois ..... A47F 5/116 211/149
5,785,189 A * 7/1998 Gollob ..... A47F 7/285 108/109
D398,462 S * 9/1998 Baluk ..... D6/683.1
6,126,022 A 10/2000 Merkel
6,585,118 B2 * 7/2003 Kellogg ..... A47F 3/001 211/13.1
D485,096 S * 1/2004 Overthun ..... D6/553
6,796,248 B1 * 9/2004 Dressendorfer ..... A47B 57/10 108/106
D530,540 S * 10/2006 Stravitz ..... D6/675.4
7,207,448 B1 * 4/2007 Marino, Jr. ..... B25H 3/023 100/54
7,886,465 B2 * 2/2011 Virvo ..... G09F 15/0068 40/539
8,133,049 B1 * 3/2012 Sullivan ..... F27D 5/0012 432/258
8,651,298 B2 * 2/2014 Beaty ..... A47B 47/042 211/135
8,813,980 B1 * 8/2014 Billman ..... A47B 96/021 211/187
9,204,719 B2 * 12/2015 Hu ..... A47B 45/00
9,655,446 B2 * 5/2017 Brady ..... A47F 5/114
9,782,021 B2 * 10/2017 Shaffer ..... A47F 5/112
10,034,806 B1 * 7/2018 Greenhalgh, Sr. ..... A61G 7/05
2003/0066813 A1 * 4/2003 Taylor ..... A47B 47/042 211/186
2004/0211739 A1 * 10/2004 Lembe ..... A47F 5/0025 211/133.1
2006/0169656 A1 8/2006 Belden
2006/0169659 A1 * 8/2006 Robinson ..... A47B 57/30 211/187
2007/0044692 A1 * 3/2007 Zimmer ..... A47B 87/0253 108/180
2009/0026163 A1 * 1/2009 Lee ..... F16B 12/24 211/189
2010/0133215 A1 * 6/2010 Norman ..... A47B 87/0261 211/85.8
2012/0223041 A1 * 9/2012 Lee ..... A47B 57/04 211/150
2013/0062299 A1 * 3/2013 Beaty ..... A47F 5/116 211/153
2013/0097903 A1 * 4/2013 Gerstner ..... G09F 7/18 40/541
2015/0257531 A1 * 9/2015 Han ..... A47B 47/0091 211/187
2015/0290528 A1 * 10/2015 Sampson ..... A63F 1/14 273/149 R
2016/0029786 A1 * 2/2016 Davis ..... B60B 33/00 211/85.8
2020/0015586 A1 * 1/2020 Romantic ..... A47B 57/404

* cited by examiner

SHELVING DISPLAY SYSTEM

TECHNICAL FIELD

The present examples relate generally to shelving systems and designs, and more particularly, to modular shelving designs that may be arranged in a variety of shelf configurations, and may be used to display a variety of objects, for example retail products such as food, candy, and/or chewing gum.

BACKGROUND

Shelving display systems, particularly those requiring assembly for use in a retail environment, remain an area of interest. Some existing systems have various shortcomings, drawbacks, and disadvantages relative to certain applications. Accordingly, there remains a need for further contributions in this area of technology.

SUMMARY

The disclosed embodiments relate to a shelving display system, for example, a product display for a retail environment.

In one example, the shelving display may include a first shelf having first and second end portions on opposite ends of a first shelf. The first endcap may include first, second, third, and fourth faces. The first and second faces may be on opposite sides of the first endcap, and the third and fourth faces may be on opposite sides of the first endcap. The first face may include a first support structure comprising a first slot recess that slideably engages and supports a first end portion of the first shelf. The first slot recess may include a first slanted portion slideably engaged with the first end portion of the first shelf. The first slot recess may also include a second slanted portion symmetrical to the first slanted portion about a vertical axis. The third face may include a first protrusion, and the fourth face may include a first groove complementary to the first protrusion and sized to slideably engage the first protrusion.

The shelving display may include a second endcap having fifth, sixth, seventh, and eighth faces. The fifth face may include a second support structure comprising; a second slot recess that slideably engages and supports the second end portion of the first shelf. The second slot recess may be substantially identical to the first slot recess, with third and fourth slanted portions substantially identical to the first and second slanted portions, respectively. The fourth slanted portion may be slideably engaged with the second end portion of the first shelf.

In another example, the second endcap may include a second protrusion substantially identical to the first protrusion, and a second groove substantially identical to the first groove. In a further example, the shelving display may include a first header and a second header attached to the first endcap and second endcap, respectively. The first header may include a first structure engaged with one of the first protrusion or first groove, and the second header may include a second structure engaged with one of the second protrusion or the second groove. In a further example, the shelving display may include a light emitting diode (LED) or other illuminating source attached to at least one of the header or endcaps. Wires providing power to the illuminating source may be at least partially hidden within at least one of the endcaps.

In another example, a first groove may extend through a surface of at least one of the first or second faces. The first groove may include a first width $W_1$ at the surface of the fourth face, and a second width $W_2$ greater than $W_1$ in an interior of the first groove. The first protrusion may have a third width $W_3$ at the surface of the third face. The first protrusion may have a fourth width $W_4$ greater than $W_3$ at a distance away from the third face, and where $W_3$ is less than or equal to $W_1$, and $W_4$ is less than or equal to $W_2$.

In a further example, the shelving display may include a third endcap having a third groove substantially identical to the first groove of the first endcap. The portion of the first protrusion having width greater than $W_3$ may comprise a first tongue. The first tongue may be constructed and dimensioned such that during an assembly step when the first protrusion is advanced through the third groove, the first tongue deflects from a resting configuration to an assembled configuration as a portion of a third endcap slides between the first tongue and the third face. In a further example, the portion of the first protrusion having width greater than $W_3$ may further comprise a second tongue. The second tongue may be constructed and dimensioned such that during an assembly step when the first protrusion is advanced through the third groove, the second tongue deflects from a resting configuration to an assembled configuration as a portion of a third endcap slides between the second tongue and the third face.

In another example, the first protrusion may protrude from a base of a first depression on the third face. The first groove may be set in a surface of a first rail. The first depression may be complementary in shape to the first rail and may be sized to slideably engage the first rail.

In another example, the shelving display system may include an interlocking mechanism having a first nub on the third face and a second nub on the fourth face. The third endcap may include a third nub substantially identical to the second nub. The first nub may be constructed and dimensioned such that during an assembly step when the third nub is advanced past the first nub, both the first and third nubs deflect from a resting configuration to a deflected configuration as the first and third nubs slide past each other to achieve an assembled state. The first and third nubs may return to the resting configuration in the assembled state.

The methods and systems disclosed herein are nonlimiting and may be applied to other shelving and display systems. Any appropriate number of endcaps may be stacked upon one another in a given example. Likewise, any appropriate number of shelves may be used in a given example. Other systems, methods, features and advantages of the invention will be, or will become, apparent to one with skill in the art upon examination of the following figures and detailed description. It is intended that all such additional systems, methods, features and advantages be within the scope of the invention, and be encompassed by the following claims.

BRIEF DESCRIPTION OF THE DRAWINGS

The invention can be better understood with reference to the following drawings and description. The components in the figures are not necessarily to scale (although certain figures may be drawn to scale and relied upon as such), emphasis instead being placed upon illustrating the principles of the invention. Moreover, in the figures, like referenced numerals designate corresponding parts throughout the different views.

DETAILED DESCRIPTION

Shelving Displays

Objects have been displayed on shelves for a long time, from the common bookshelf to displays of ancient artifacts.

In a retail environment, products for sale may be displayed on shelving. In some cases, the shelving may be brand-specific or product-specific, for example if the shelving has indicia of a certain brand or product. In some cases (e.g., customized branded shelving), the shelving may be designed and manufactured off-site and later shipped to the retail store where it is assembled.

As used herein, "modular" means designed with standardized units or dimensions to permit easy assembly and easy, flexible interchangeability. "Modular" further means that an element (e.g., endcap) can be arranged or fitted together with other similar (including substantially identical) and/or different elements in a variety of ways.

Modular shelving components may lower manufacturing costs (fewer unique components), may lower shipping costs (simpler and/or lower mass packaging), and may facilitate an easier assembly. Modular components that reduce the number of overall components required for assembly improve all three by reducing manufacturing costs, shipping costs (weight), and assembly time.

As used herein, the term "substantially identical" means two or more objects constructed within the same design tolerances. While two objects may be slightly different (e.g., have slightly different dimensions), they may be similar enough to one another that they are interchangeable for their intended purpose, and thus herein referred to as "substantially identical." The term "substantially identical," as defined and used herein, will thus include structures that are exactly alike, as well as those that are sufficiently visually alike that they could be mistaken for each other by an ordinary observer, and including that one of skill in the art would immediately visually acknowledge at least a strong resemblance.

As used herein, the terms "protrusion," "rail," and "nub" all refer to convex structures jutting out from a given surface. To avoid confusion, the term "protrusion" is used to refer to the structures of the endcap-to-endcap attachment mechanism, the term "rail" is used to refer to the structures of the endcap alignment mechanism, and the term "nub" is used to refer to the structures of the endcap interlocking mechanism.

Similarly, the terms "groove" and "depression" both refer to concave structures jutting in at a given surface. To avoid confusion, the term "groove" is used to refer to the structures of the endcap-to-endcap attachment mechanism (corresponding to protrusion) and the term "depression" is used to refer to the structures of the endcap alignment mechanism (corresponding with rail).

Figure 1:
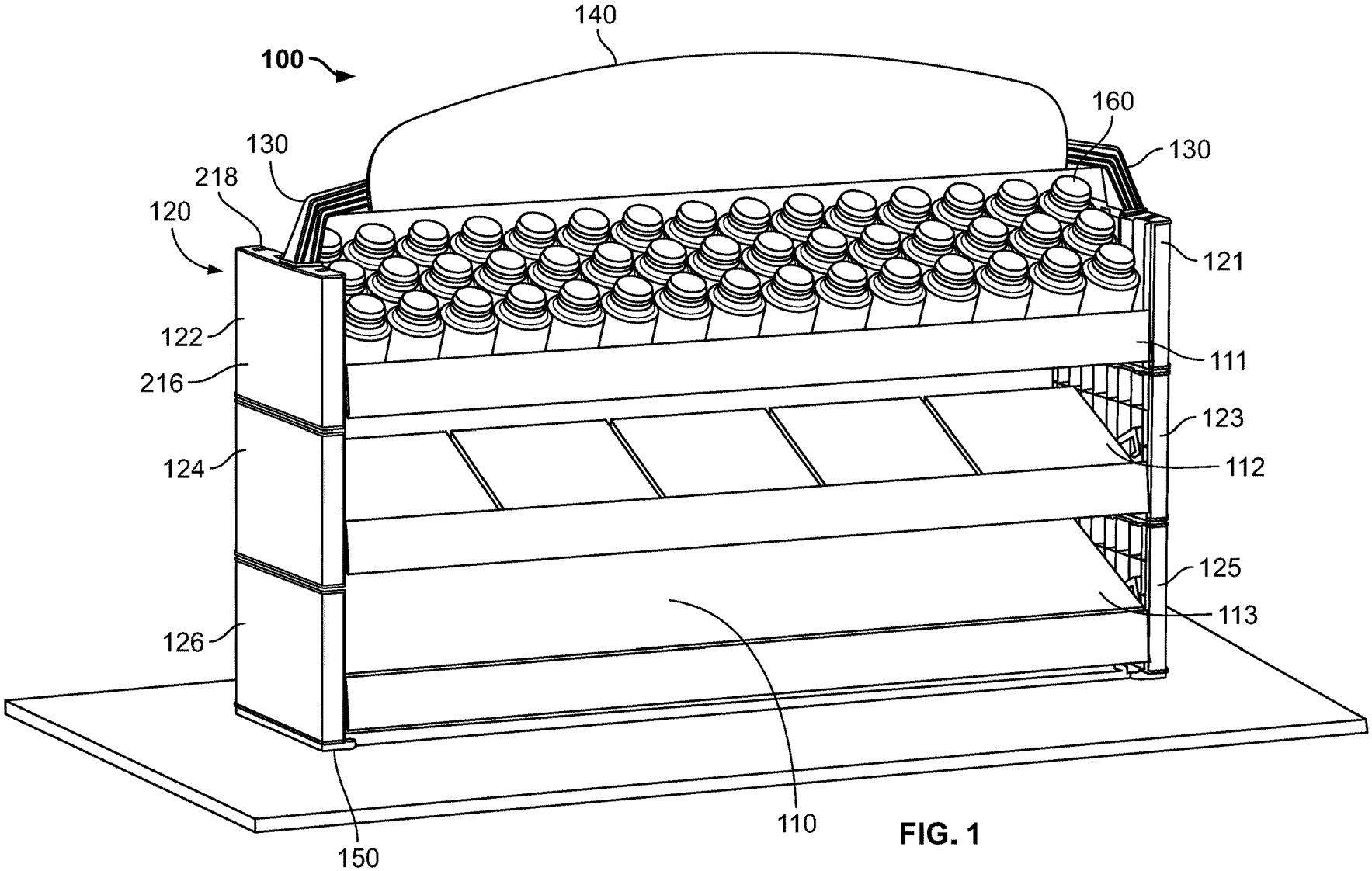
FIG. 1 is a perspective view of one example of a shelving display system.
Figure 3:
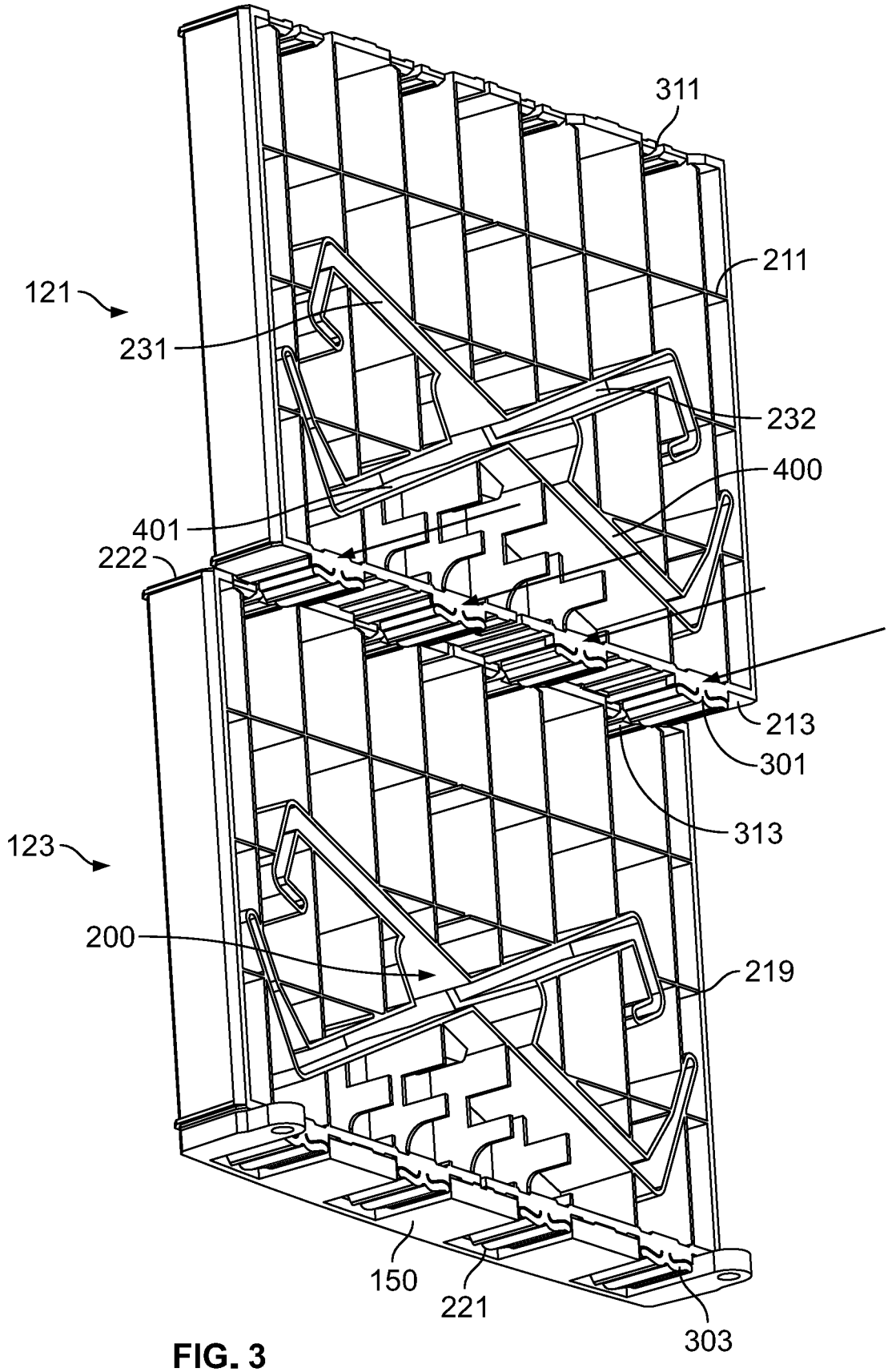
FIG. 3 illustrates an internal perspective view of two endcaps, with arrows illustrating slideable engagement.

FIG. 1 illustrates one example of a shelving display 100. The shelving display 100 may have shelves 110, endcaps 120, a header 130, header display 140, and base 150. The endcaps 120 may each have support structures 200 (FIG. 3). The top shelf is shown with products 160 displayed, though products 160 may be displayed on any and/or all of the shelves 110 and may be of any shape and size. Each of the shelves 110 may be attached to two endcaps 120, one at each of the longitudinal ends (left and right ends). The shelves 110 may be slanted forward (as shown), slanted rearward (not shown), or flat (not shown) (for example, by the inclusion of a third slot or other appropriate mechanism). The endcaps 120 may be stacked upon one another and may also be attached to one another. Headers 130 may be attached to the top endcaps 120 (left and right), thereby spanning the longitudinal length of the shelving. The header display 140 may be attached to the headers 130, may be aligned in the center of the shelving display 100, and may include advertising indicia.

The shelves 110 may comprise a first shelf 111, a second shelf 112, and a third shelf 113. The endcaps 120 may comprise a first endcap 121, a second endcap 122, a third endcap 123, a fourth endcap 124, a fifth endcap 125, and a sixth endcap 126. The shelving display may include any number of shelves (with corresponding endcaps).

Endcaps & Shelving Support Structure

Figure 2:
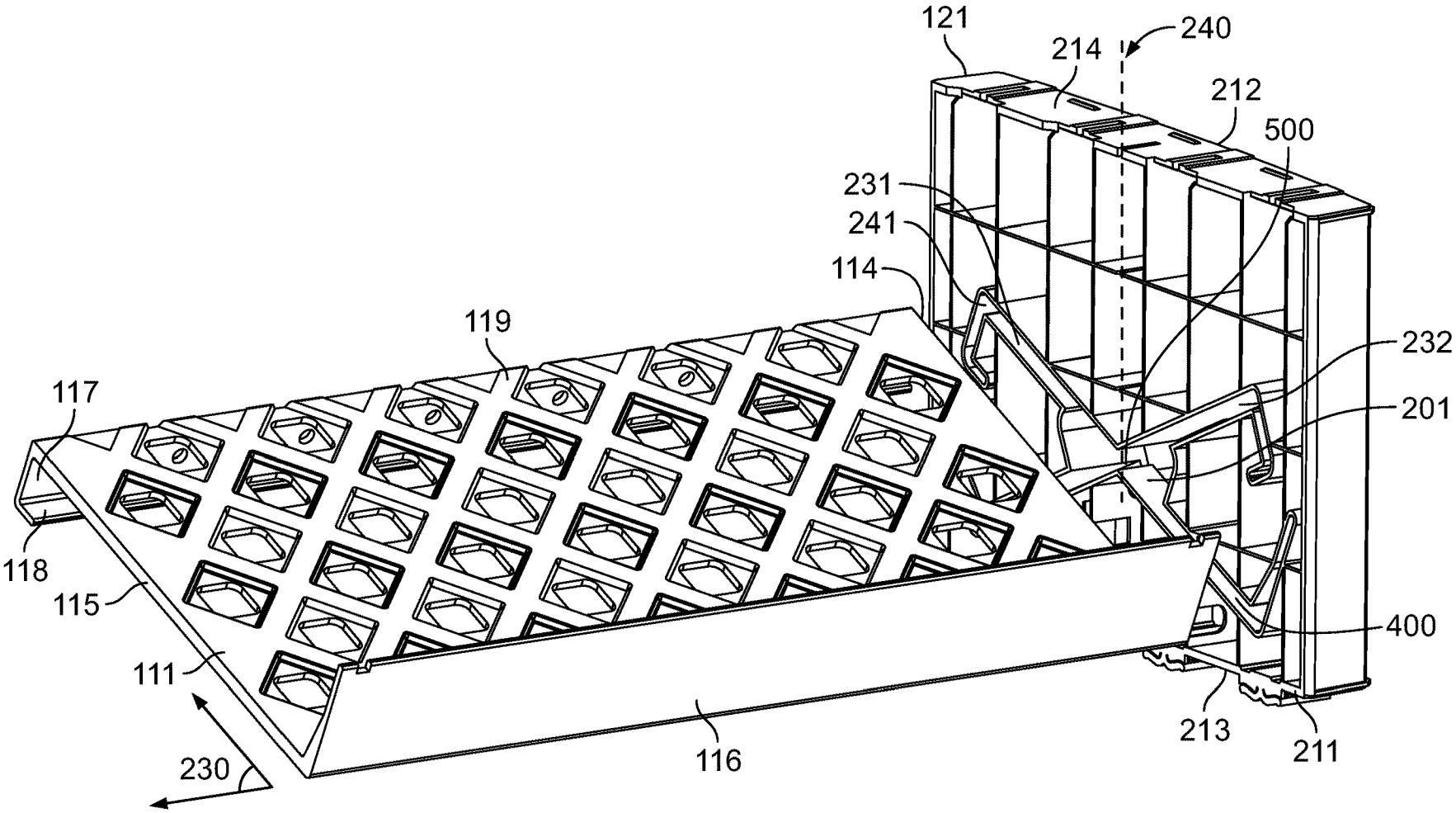
FIG. 2 illustrates a perspective view of one example of a shelving display system having a shelf and an endcap.

FIG. 2 illustrates a first shelf 111 and first endcap 121, where the two components are separated yet aligned for engagement with one another. The first shelf 111 may have a first end portion 114 (here, right side) and a second end portion 115 (here, left side), wherein the first and second end portions 114 and 115, respectively, are on opposite sides of the shelf. The front of the first shelf 111 may have a first front lip 116. The rear of the first shelf 111 may have a first rear lip 117. The first front lip 116 may deflect upwards and the first rear lip 117 may deflect downwards. The tip 118 of the first rear lip 117 may further deflect in a separate direction, for example, towards the front of the first shelf 111 (as shown). The front and rear lips 116 and 117 may also deflect in other directions or not at all (not shown). The top surface 119 of the first shelf 111 may have portions removed, for example forming a grid-like pattern (as shown), or may be solid (not shown).

The first endcap 121 (FIG. 2) may have a first face 211, a second face 212, a third face 213, and a fourth face 214. The first and second faces 211 and 212, respectively, may be on opposite sides of the first endcap 121, for example on the internal and external major faces (as shown). The third and fourth faces 213 and 214, respectively, may be on opposite sides of the first endcap 121, for example on the bottom and top surfaces, respectively.

The second endcap 122 (FIG. 1) may have a fifth face 215, a sixth face 216, a seventh face 217 (FIG. 16), and an eighth face 218. The fifth and sixth faces 215 and 216, respectively, may be on opposite sides of the second endcap 122, for example on the internal and external major faces (as shown). The seventh and eighth faces 217 and 218, respectively, may be on opposite sides of the second endcap 122, for example on the bottom and top surfaces, respectively.

The first face 211 of the first endcap 121 may have a first support structure 201 that supports the first end portion 114 of the first shelf 111. The second endcap 122 (FIGS. 1, 16) may have a second support structure 202 (FIG. 16) that supports the second end portion 115 of the first shelf 111. The first and second support structures 201 and 202, respectively, may comprise first slot recess 241 (FIG. 2) and second slot recess 242 (FIG. 16) in the first face 211 and fifth face 215, respectively. The first and second slot recesses 241 and 242, respectively, may be constructed and dimensioned to slideably engage the first and second end portions 114 and 115, respectively, of the first shelf 111.

During an assembly step, the first end portion 114 may slide into the first slot recess 241 of the first face 211, and the second end portion 115 may slide into the second slot recess 242 of the fifth face 215. Upon assembly, the first and second end portions 114 and 115 of the first shelf 111 are slideably engaged with first and second slot recesses 241 and 242, respectively. Friction between the first shelf 111 and the first and second slot recesses 241 and 242 may help the first shelf 111 resist disengagement from the first and second end caps 121 and 122, respectively.

The first shelf 111 may be slanted at an angle 230 relative to the ground. Angle 230 may have a positive slope (sloping towards the front of the shelving display 100, as shown) or negative slope (sloping towards the rear of the shelving display 100, not shown) or no slope at all (not shown). As shown in FIG. 2, the first slot recess 241 in the first face 211 may have a first slanted portion 231, wherein the first end portion 114 of the first shelf 111 is slideably engageable with the first slanted portion 231. The first slot recess 241 in the first face 211 may also have a second slanted portion 232 symmetrical to the first slanted portion 231 about a vertical axis 240. When the first shelf 111 is engaged with the first slanted portion 231, the second slanted portion 232 may be open/vacant, and vice-versa. The first slot recess 241 in the first face 211 may also have a center 500, a third slanted portion 401, and a fourth slated portion 400 symmetrical to the third slanted portion 401 about the vertical axis 240. The first slanted portion 231 extends diagonally upward from the center 500 of the first slot recess 241. The second slanted portion 232 extends diagonally upward from the center 500 of the first slot recess 241. The third slanted portion 401 extends diagonally downward from the center 500 of the first slot recess 241 and the fourth slanted portion 400 extends diagonally downward from the center 500 of the first slot recess 241. The first slot recess is generally X-shaped.

Figure 16:
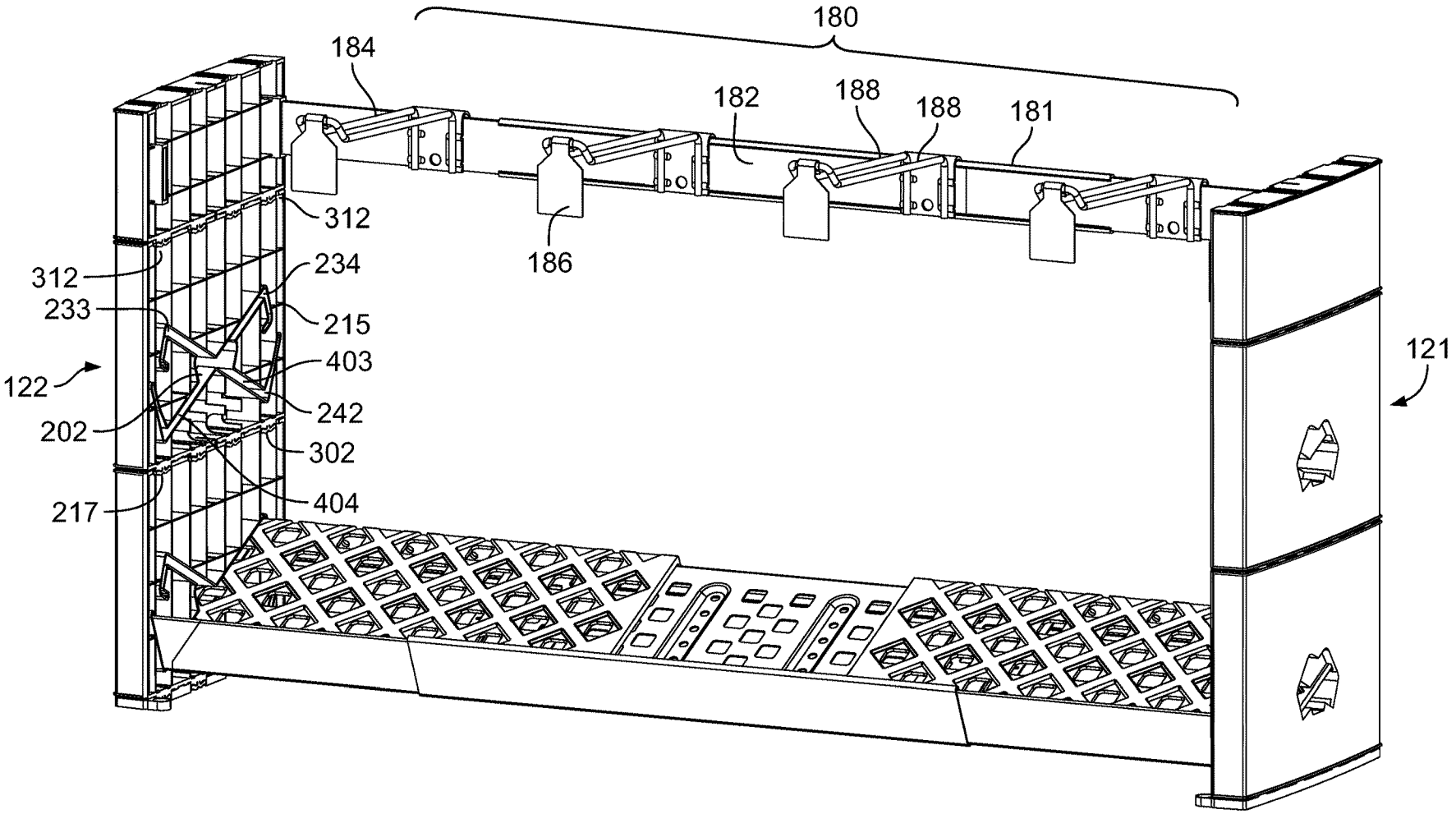
FIG. 16 illustrates a front perspective view of one example of a shelving display system having multiple hooks.

The second slot recess 242 may be substantially identical to the first slot recess 241, thereby having a fifth slanted portion 233 a sixth slanted portion 234, a seventh slanted portion 403, and an eighth slanted portion 404 substantially identical to the first 231 the second 232, the third 400, and the fourth 401 slanted portions, respectively (see FIG. 16). In such a configuration, the second end portion 115 of the first shelf 111 may be slideably engaged with the sixth slanted portion 234 of the second slot recess 242 (not shown in FIG. 16).

In another example, the first and second support structures 201 and 202, respectively, may comprise one or more ledges protruding from the first face 211 and fifth face 215, respectively (not shown). In such an example, the first shelf 111 may rest on the ledges instead of being inserted into the slot recesses.

Endcap-to-Endcap Attachment

Figure 4:
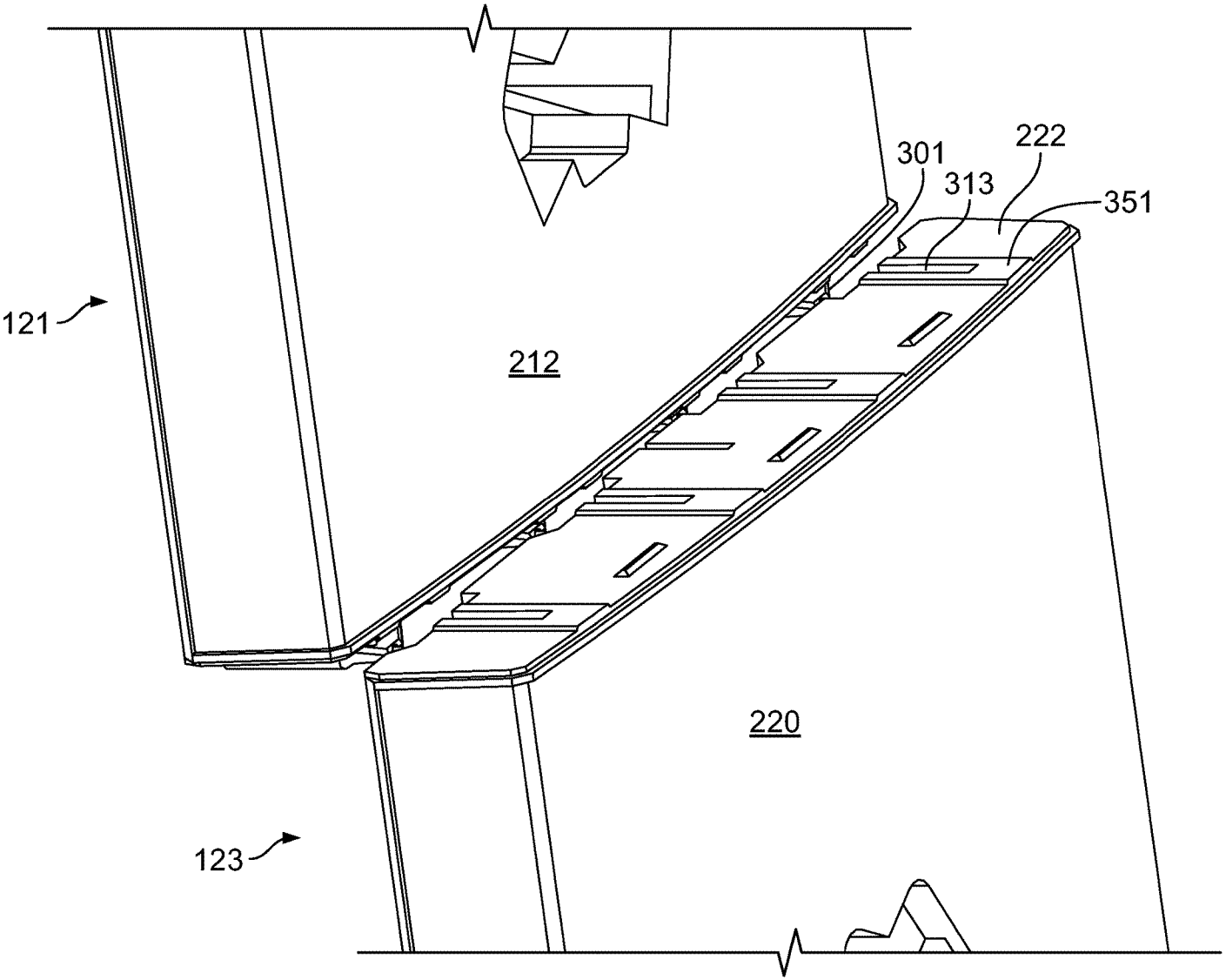
FIG. 4 illustrates a zoomed-in external perspective view of two endcaps aligned for slideable engagement.

FIGS. 3-4 illustrate the first endcap 121 aligned for slideable engagement with the third endcap 123 (although any other appropriate means of engagement may be used, including without limitation magnets, adhesive, snapping mechanisms, or other appropriate attachment mechanisms). The third endcap 123 may have a ninth face 219, a tenth face 220, an eleventh face 221, and a twelfth face 222. The ninth and tenth faces 219 and 220, respectively, may be on opposite sides of the third endcap 123, for example on the internal and external major faces (as shown). The eleventh and twelfth faces 221 and 222, respectively, may be on opposite sides of the third endcap 123, for example on the bottom and top surfaces, respectively.

The third face 213 of the first endcap 121 may have a first protrusion 301, and the fourth face 214 may have a first groove 311 complementary to the first protrusion 301 and sized to slideably engage a protrusion on another endcap that is substantially identical to the first protrusion 301.

Similarly, the seventh face 217 (FIG. 16) of the second endcap 122 may have a second protrusion 302 (FIG. 16), and the eighth face 218 of the second endcap 122 may have a second groove 312 (FIG. 16) complementary to the second protrusion 302 and sized to slideably engage a protrusion on another endcap that is substantially identical to the second protrusion 302. Likewise, the eleventh face 221 of the third endcap 123 may have a third protrusion 303 (FIGS. 3 and 10), and the twelfth face 222 of the third endcap 123 may have a third groove 313 complementary to the third protrusion 303 and sized to slideably engage a protrusion on another endcap that is substantially identical to the third protrusion 303 (FIG. 3).

The first, second, and third protrusions 301, 302, and 303 may be substantially identical, and the first, second, and third grooves 311, 312, and 313 may also be substantially identical, respectively. Similarly, a given face (e.g., third face 213) may have multiple protrusions substantially identical to the first protrusion 301, and other faces (e.g., fourth face 214) may have multiple grooves substantially identical to the first groove 311. Multiple groove/protrusion pairs may provide the respective endcaps 120 with more secure engagement with one another.

Focusing now on the first groove 311 (which may be substantially identical to the second groove 312 and third groove 313), the first groove 311 may extend along the fourth face 214, extending through to at least one of the first face 211 or second face 212. For example, FIG. 4 illustrates this with third groove 313 which in this example is substantially identical to first groove 311: The third groove 313 (first groove 311) may extend along the twelfth face 222 (fourth face 214) to the ninth face 219 (first face 211), which is the internally-facing major face. This allows the protrusions (e.g., 301, 302, and 303) to slide into the grooves (e.g., 311, 312, and 313) from the side connected with the respective groove (here, from the internal sides/faces 211, 215, and 219).

Figure 10:
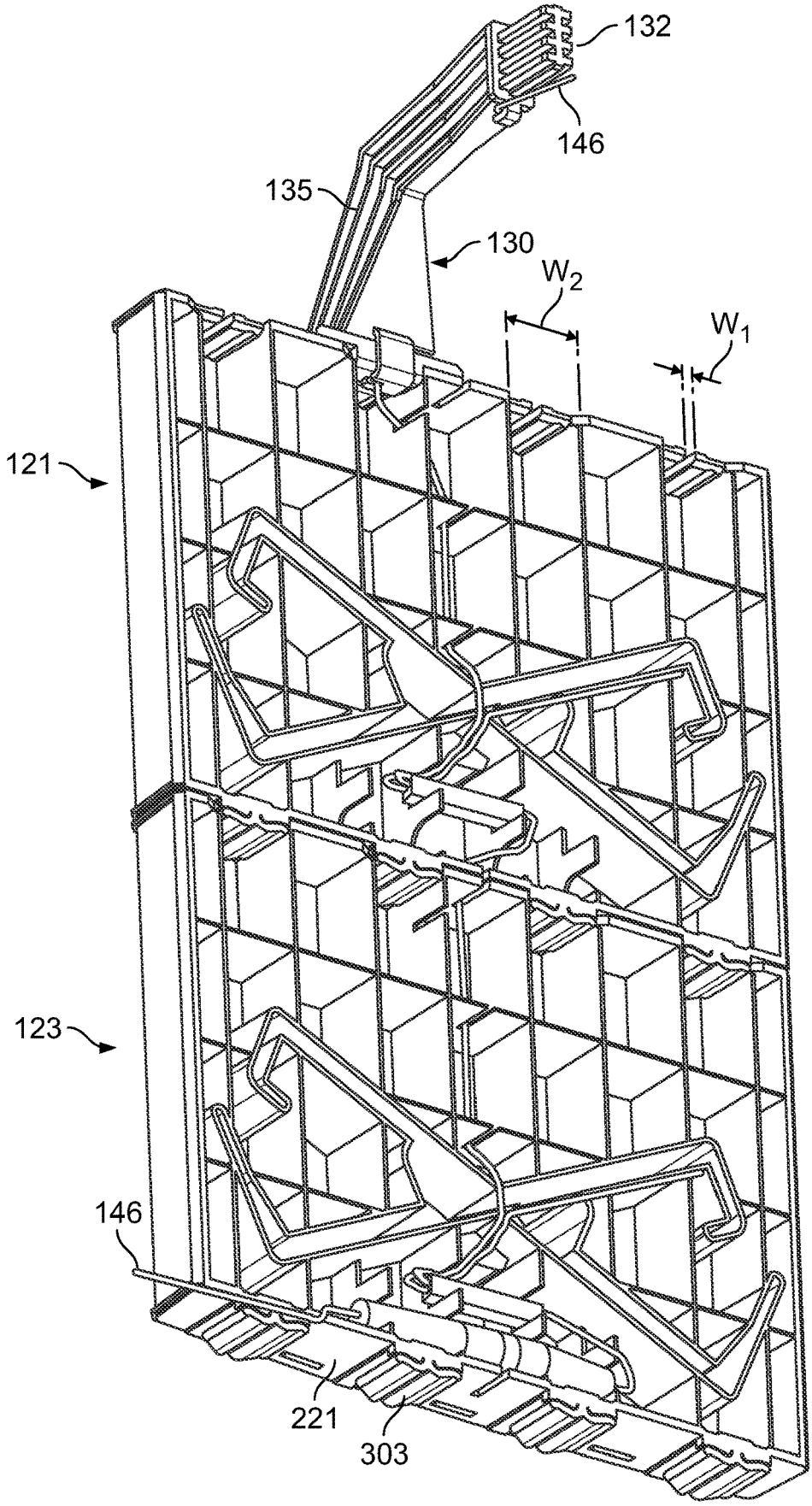
FIG. 10 illustrates a perspective view of a header attached to an endcap connected to one other endcap and having wiring running from the header through the endcaps, in one example of a shelving display system.

The first groove 311 may have a first width $W_1$ at the surface of the fourth face 214, and a second width $W_2$ greater than $W_1$, as shown in FIG. 10, in the interior of the first groove 311. Thus, the first groove 311 may accommodate protrusions having variable widths, for example, protrusions having "T-shaped" or "L-shaped" cross-sections.

Figure 5A:
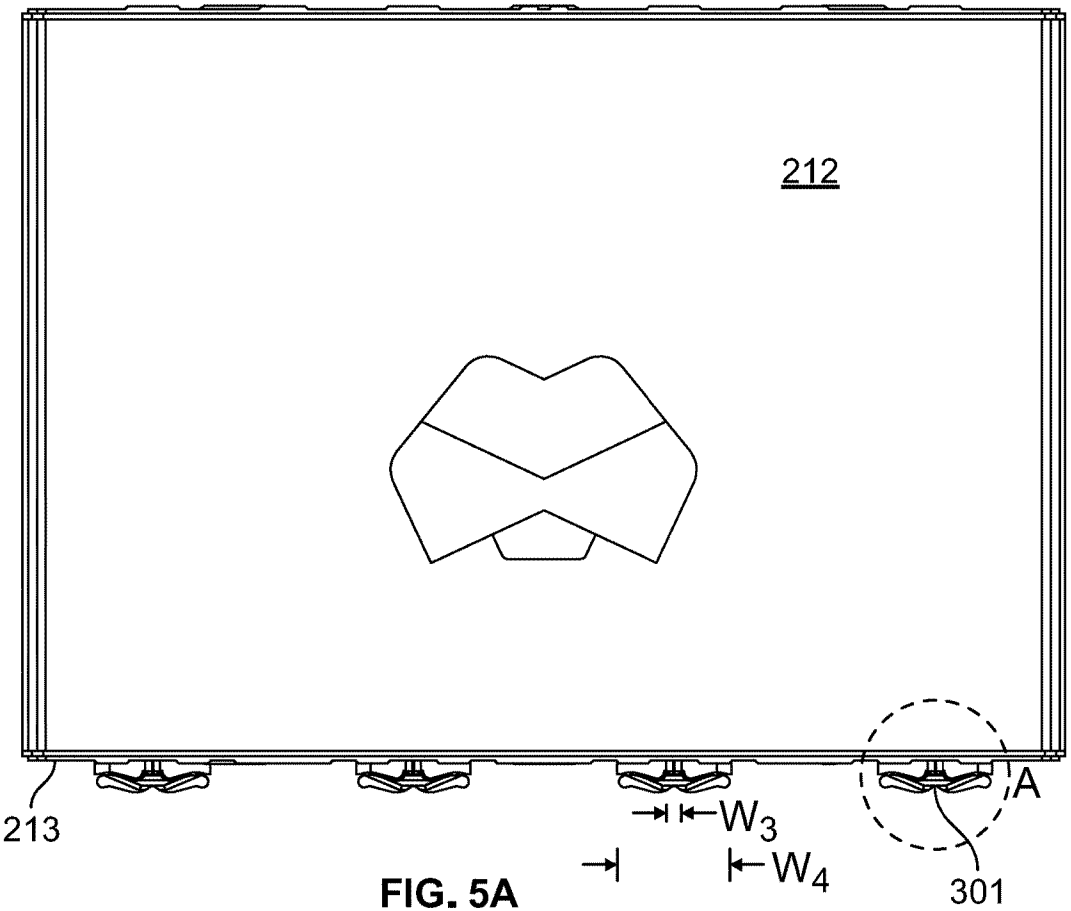
FIGS. 5A-5C illustrate side, front, and bottom views, respectively, of an endcap of one example of a shelving display system.
Figure 5B:
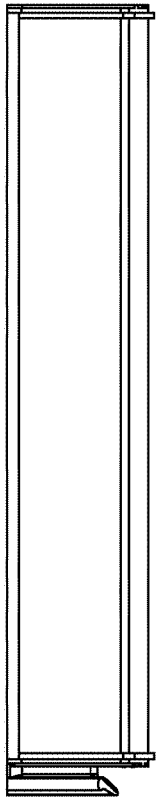
Figure 5C:
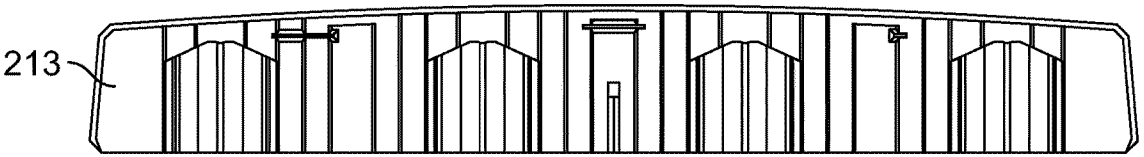

As shown in FIGS. 5A-5C, the first protrusion 301 may have a third width $W_3$ at the surface of the third face 213, and a fourth width $W_4$ greater than $W_3$ at a distance away from the third face 213. In one example, $W_3$ may be less than or equal to $W_1$, and $W_4$ may be less than or equal to $W_2$. Accordingly, protrusions shaped like the first protrusion 301 may slide within grooves shaped like first groove 311.

Figure 5D:
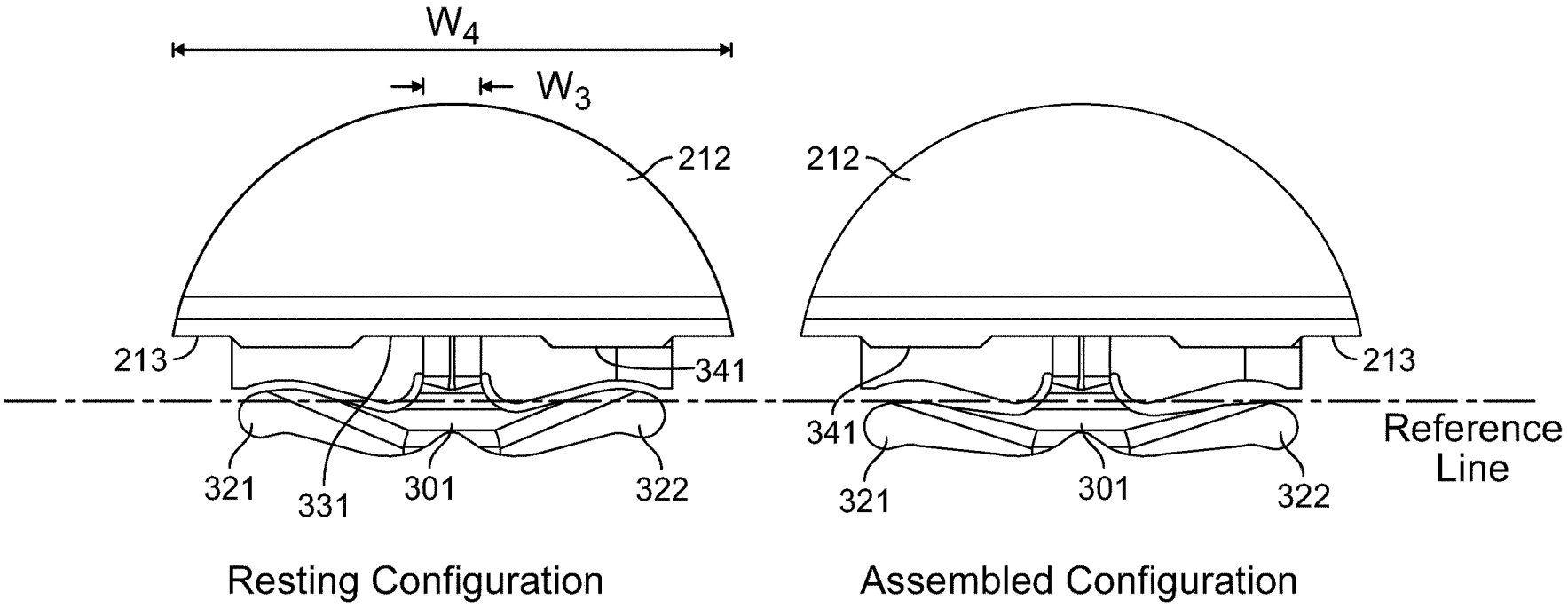
FIG. 5D illustrates a zoomed-in side view of a protrusion of an endcap having tongues in a resting state (left) and an assembled state (right).

FIG. 5D illustrates zoomed-in views of one example of the first protrusion 301, where first protrusion 301 has widths $W_3$ and $W_4$ as described above. The portion of the first protrusion having width greater than $W_3$ may comprise a first tongue 321 and a second tongue 322. The first tongue 321 may be constructed and dimensioned such that during an assembly step when the first protrusion 301 is advanced through the third groove 313, the first tongue 321 deflects from a resting configuration (FIG. 5D, left) to an assembled configuration (FIG. 5D, right) as a portion of a third endcap 123 (not shown) slides between the first tongue 321 and the third face 213 of the first endcap 121. The second tongue 322 may also deflect in the same direction via the same mechanism during the assembly step.

A reference line is shown in FIG. 5D spanning the left image (resting configuration) and the right image (assembled configuration) to illustrate the downward deflection of the first and second tongues 321 and 322, respectively, during the assembly step. While not shown in FIG. 5D, a portion of the third endcap 123 (e.g., portions of twelfth face 222 adjacent to third groove 313) may be pinched between the first tongue 321 and the third face 213 of the first endcap 121 (and pinched between the second tongue 322 and the third face 213). Thus, the downward deflection of the first and second tongues 321 and 322, respectively, provides a tension force between the first endcap 121 and third endcap 123, thereby increasing the frictional engagement between the two endcaps.

Endcap Alignment

Figures 6A, 6B, 6C:
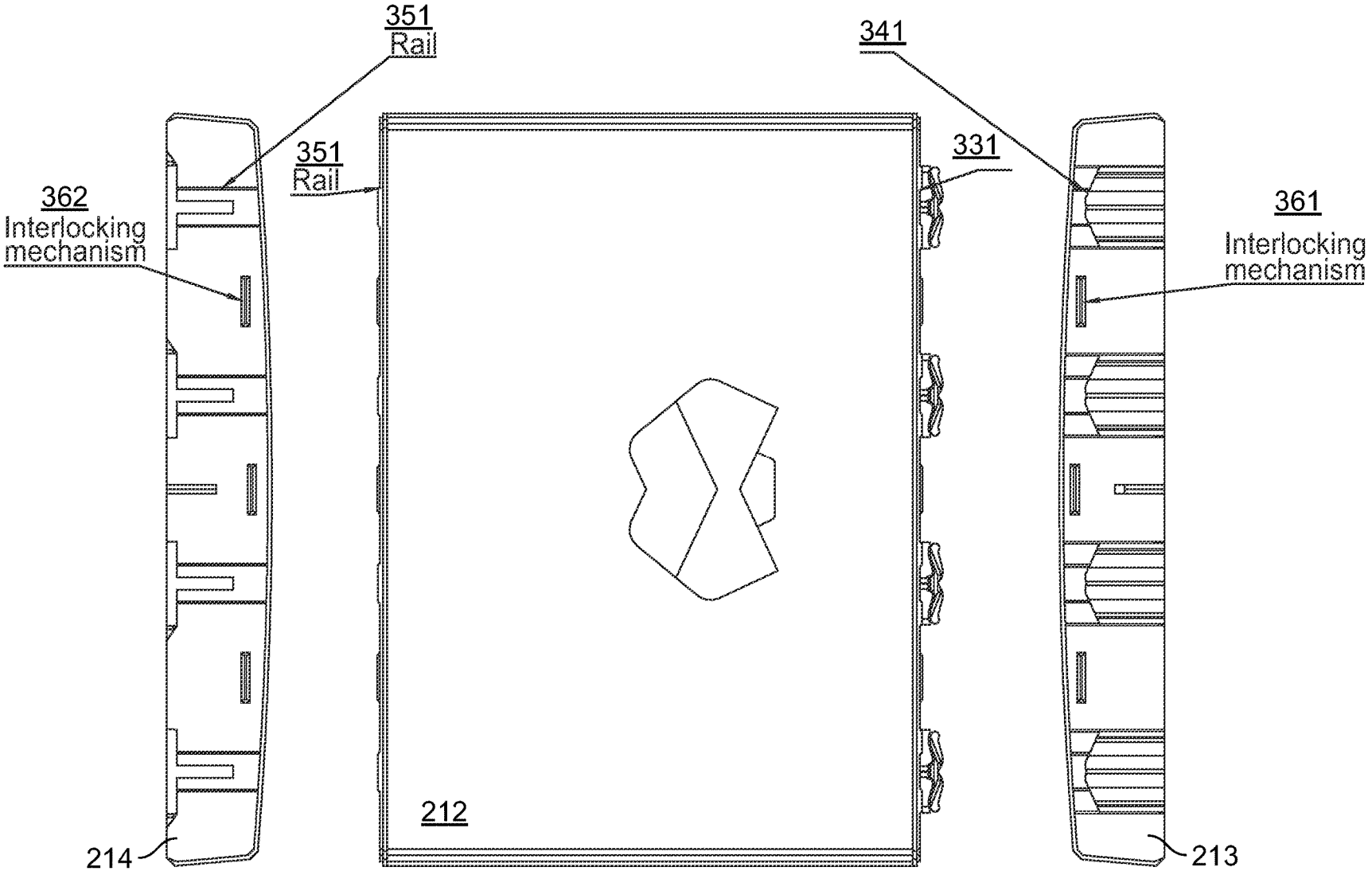
FIGS. 6A-6C illustrate side, top, and bottom views, respectively, of an endcap of one example of a shelving display system.

As shown in FIG. 5D, the first protrusion 301 may protrude from a base of a first depression 331 on the third face 213. The first depression 331 may be formed between two raised portions 341 (as shown) or the first depression 331 may be a concave indent in the third face 213 (not shown). Similarly, as shown in FIGS. 4 and 6, the first groove 311 may be set in a surface of a first rail 351 on the fourth face 214. The first depression 331 may be complementary to the first rail 351 and sized to slideably engage the first rail 351.

The third face 213 may have one or more depressions substantially identical to the first depression 331 (e.g., four depressions as shown), and the fourth face 214 may have one or more rails substantially identical to the first rail 351 (e.g., four rails as shown). Furthermore, the twelfth face 222 of the third endcap 123 may have rails substantially identical to the rails of the fourth face 214 of the first endcap 121. In such a configuration, each of the depressions on the third face 213 (e.g., first depression 331) may be aligned with a complementary rail on the twelfth face 222 (e.g., substantially identical to first rail 351 on fourth face 214).

The multiple rail/depression pairs may help to align the respective endcaps 120 prior to and during the assembly step. The rails may slide within the depressions, thereby centering the protrusions relative to the grooves. This may help make assembly of the shelving display 100 easier.

Endcap Interlocking

Figures 7A, 7B, 7C:
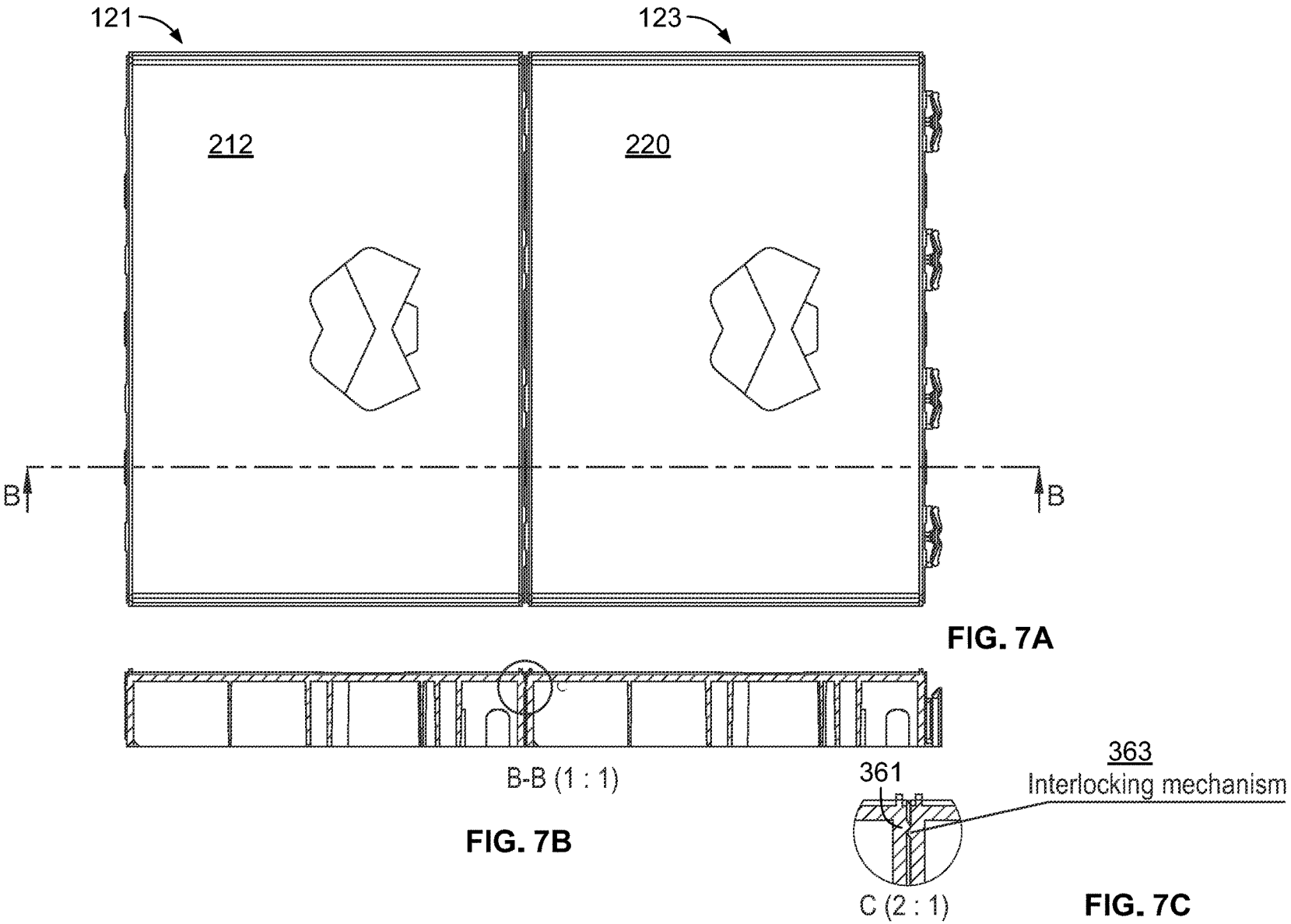
FIGS. 7A-7C illustrate side, sectional (along view "B-B"), and zoomed-in sectional ("C") views, respectively, of one example of a shelving display system having two stacked endcaps with an interlocking mechanism.

FIGS. 6-7 illustrate an endcap interlocking mechanism. The third face 213 may have a first nub 361 protruding from the surface of the third face 213. The fourth face 214 may have a second nub 362 protruding from the surface of the fourth face 214. The third face 213 may have one or more nubs substantially identical to the first nub 361 (e.g., three nubs as shown), and the fourth face 214 may have one or more nubs substantially identical to the second nub 362 (e.g., three nubs as shown). Furthermore, the twelfth face 222 of the third endcap 123 may have a third nub 363 substantially identical to the second nub 362. The twelfth face 222 may also have one or more nubs that may be substantially identical to the third nub 363 (e.g., three nubs as shown). In such a configuration, each of the nubs on the third face 213 (e.g., first nub 361) may be aligned with a complementary nub on the twelfth face 222 (e.g., third nub 363).

Functionally, the first nub 361 may be constructed and dimensioned such that during an assembly step when the third nub 363 is advanced past the first nub 361, both the first and third nubs (361 and 363) deflect from a resting configuration to a deflected configuration as the first and third nubs (361 and 363) slide past each other to achieve an assembled state. In the assembled state, both the first and third nubs (361 and 363) may return to the resting configuration. This interlocking mechanism may increase the engagement between the first endcap 121 and third endcap 123 by providing mechanical resistance when the nubs are in the assembled state. The interlocking mechanism may be reversible, provided sufficient separation forces are applied to the endcaps to permit the first and third nubs (361 and 363) to deflect and slide past each other in the opposite direction. Multiple interlocking mechanisms (e.g., three nubs as shown on each of the engaged faces of the endcaps) may further increase the engagement between the endcaps. The modular nature of the endcaps means that this interlocking mechanism may be used on multiple endcaps of a shelving display 100.

Header & Wiring

Figure 8:
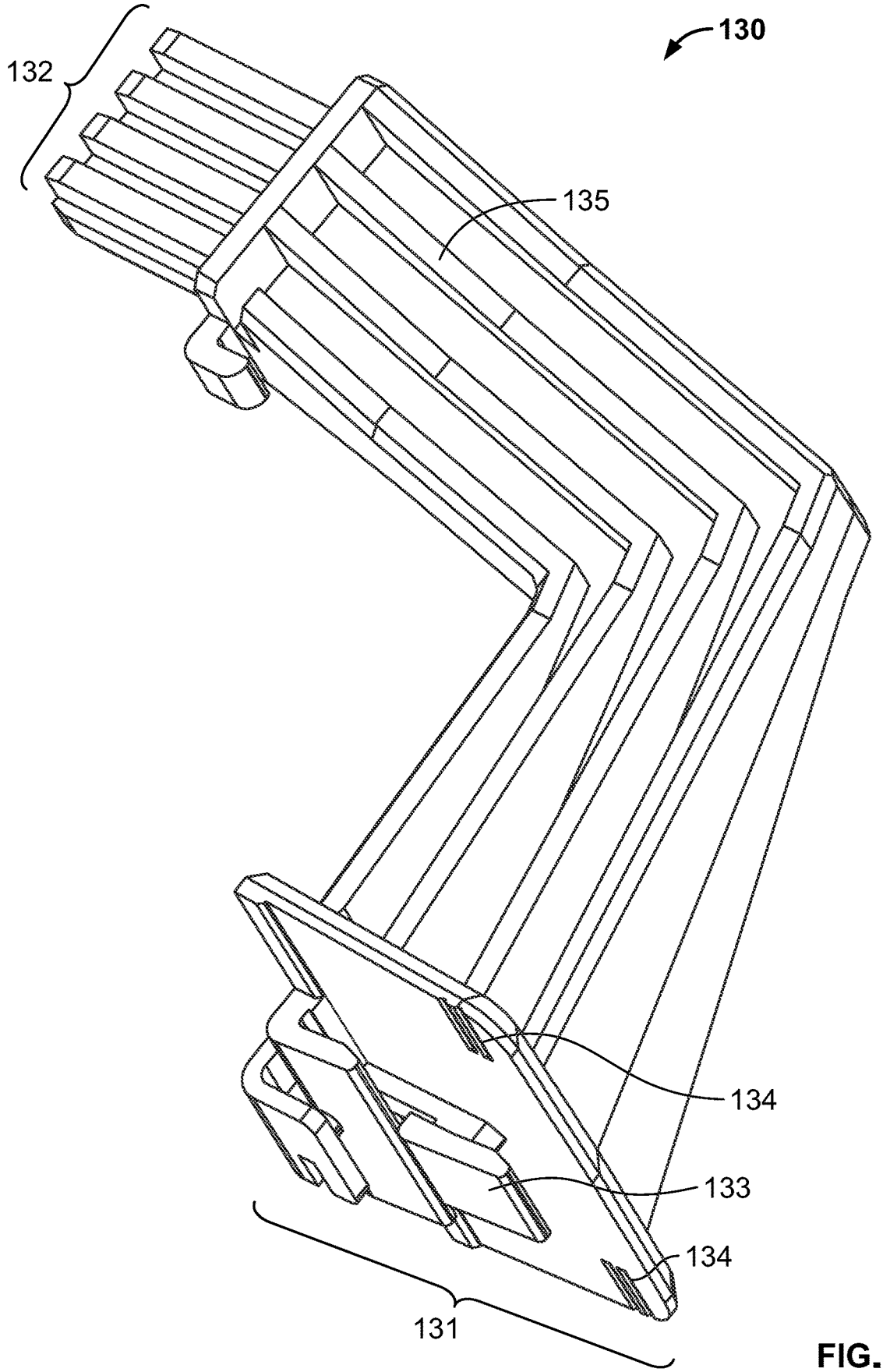
FIG. 8 illustrates a perspective view a header of one example of a shelving display system.
Figure 9:
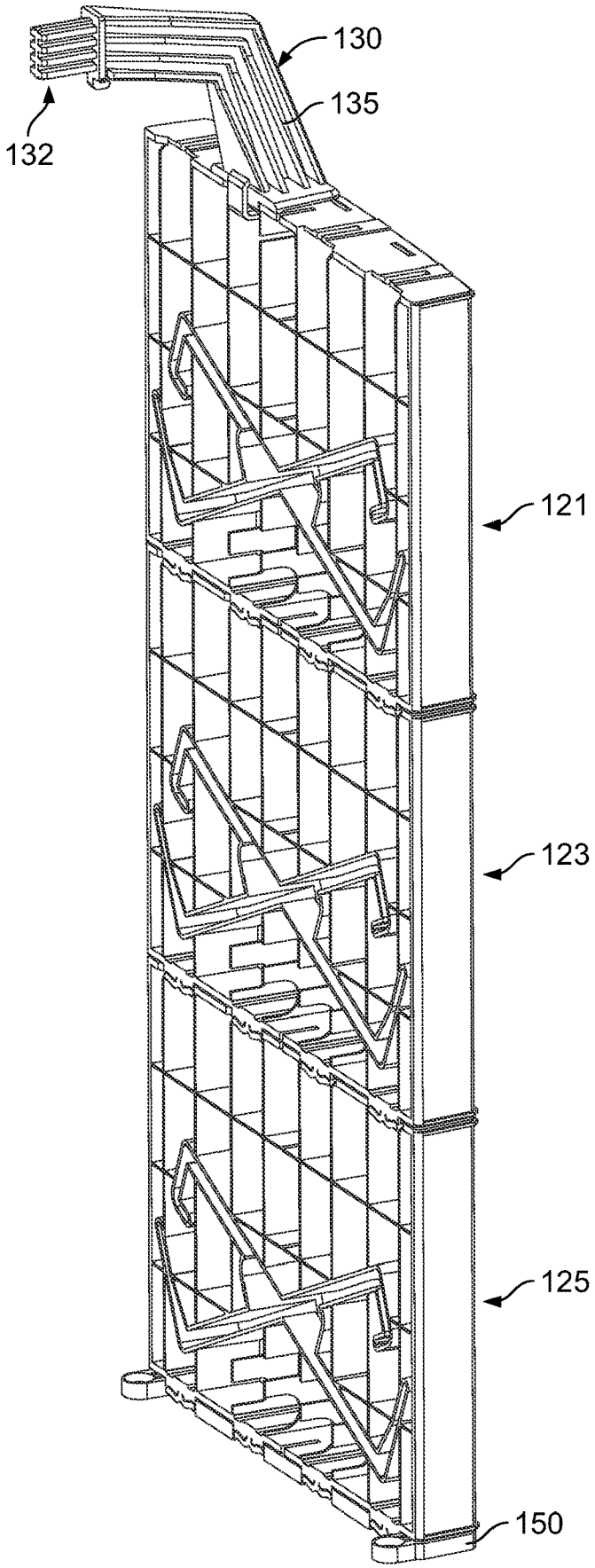
FIG. 9 illustrates a perspective view of a header attached to an endcap connected to two other endcaps, in one example of a shelving display system.

FIGS. 8-10 illustrate an example of a header 130 of a shelving display 100.

The header 130 may have an endcap attachment 131 and a header display attachment 132. The endcap attachment 131 may be compatible with the groove/protrusion structure of the endcap to which it is attached (FIG. 9). For example, as shown in FIG. 8, the endcap attachment 131 may have a header protrusion 133 that may engage with the first groove 311 on the fourth face 214 of a first endcap 121. The header protrusion 133 may be a simplified version of the first protrusion 301. The header may also have one or more nubs or partial nubs 134 that may engage with the interlocking mechanism of the endcap 121 (e.g., second nub 362 on fourth face 214 and other substantially identical nubs) in the same manner as described above.

The header display attachment 132 may be sized and dimensioned to slideably engage the header display 140. The header 130 may be reversible, such that a second header 130 may engage with a second endcap 122 via the same protrusion/groove mechanism, rail/depression mechanism, and interlocking mechanism, as described above.

The shelving display 100 may have a light source (not shown), for example, one or more light emitting diodes (LEDs). The light source may be powered by a power source (e.g., battery, electrical outlet, etc.; not shown) connected by wiring 146. The header 130 may have ribs 135, and the wiring 146 may be hidden between or within the ribs 135 (FIG. 10), thus reducing clutter and improving the visual appearance of the shelving display 100. The endcaps may also have structures with openings to hide wiring 146. The lighting source (e.g., LEDs) may also be attached to one or more endcaps or any other suitable location within the display.

Endcap Stacking Configurations

Figure 11:
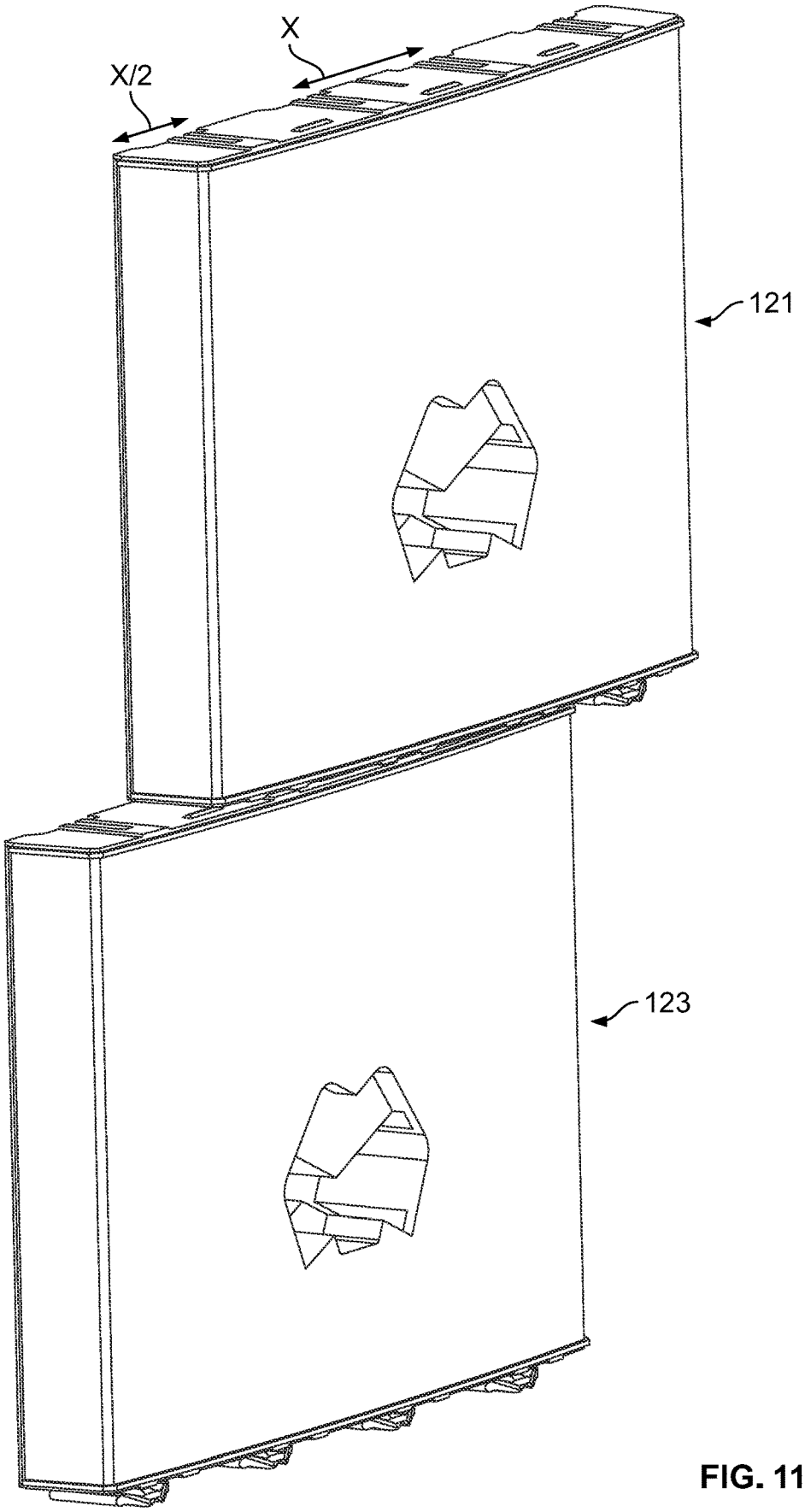
FIGS. 11-12 illustrate side perspective views of two examples of stacking configurations for endcaps of a shelving display system.
Figure 12:
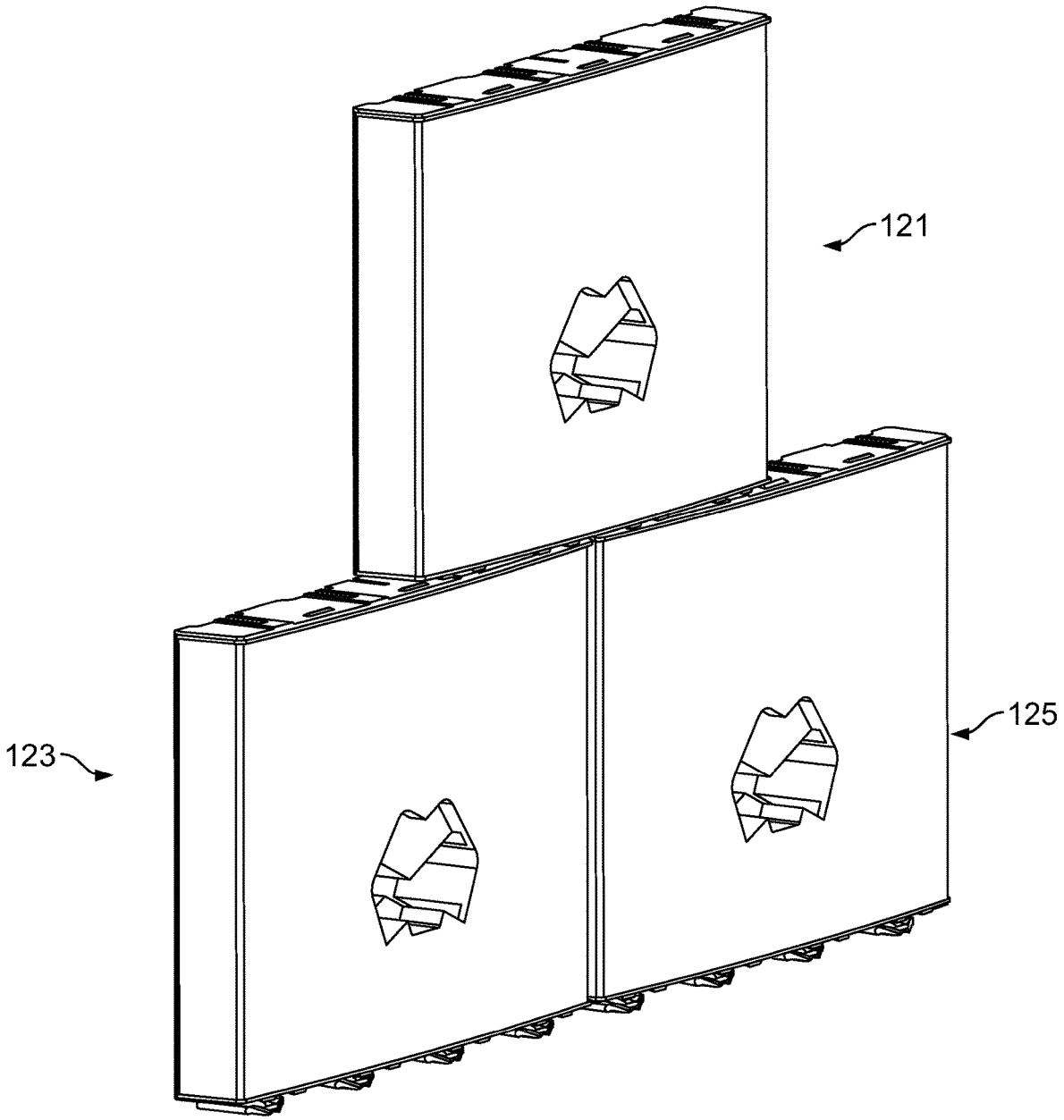

FIGS. 11-12 illustrate two alternative endcap stacking configurations. FIG. 11 shows a first endcap 121 and a third endcap 123 engaged with one another. The two endcaps may have substantially identical protrusion/groove and interlocking mechanisms. For example, the third face 213 of the first endcap 121 may have four (or any other number of) protrusions substantially identical to first protrusion 301. The twelfth face 222 of the third endcap 123 may have four (or any other number of) grooves substantially identical to the third groove 313. However, the first and third endcaps 121 and 123, respectively, may be offset from one another such that only three of the four pairs of protrusions/grooves are engaged (FIG. 11). In another example, the first and third endcaps 121 and 123, respectively, may be offset from one another such that only some, for example two of the four pairs, of protrusions/grooves are engaged (FIG. 12).

The protrusions and grooves may be equally spaced along a given endcap (e.g., inter-groove spacing="X"). The distance from the end of the endcap to the nearest protrusion or groove may be less than the inter-groove spacing (e.g., "X/2"). This allows the endcaps to be stacked in a staircase fashion (FIG. 11) or a pyramid fashion (FIG. 12).

Figure 13:
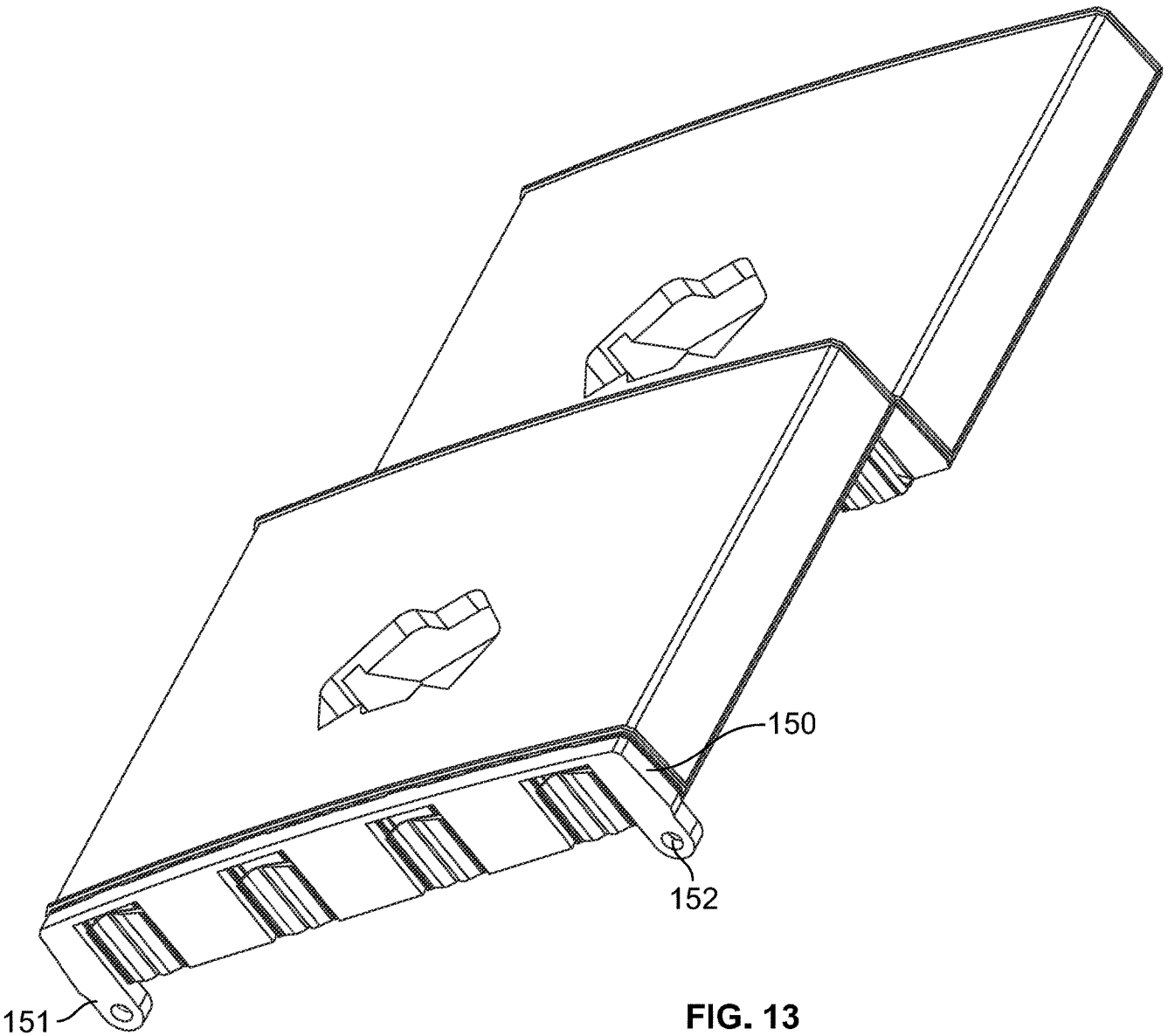
FIG. 13 illustrates a bottom perspective view of one example of a shelving display system having an endcap with feet.

The shelving display 100 may rest on any appropriate surface, for example, the floor, ground, countertop, etc. The bottom endcaps that rest on this ground, countertop, or other appropriate surface, may further comprise a base 150, as shown in FIG. 13. The base 150 may have one or more feet 151 extending laterally from the endcap, thereby providing stability to the endcap(s), especially in a stacked configuration. The one or more feet 151 may have one or more holes 152. The base may be further secured to the surface (e.g., countertop) by screwing screws through the one or more holes 152 into the surface, using double-sided tape to attach the bottom of the feet 151 to the surface, clamping the feet 151 to the surface, or using any other suitable mechanism.

The base 150 may be one contiguous piece with the endcap. Alternatively, the base 150 may engage the endcap via the same protrusion/groove mechanism, rail/depression mechanism, and interlocking mechanism, as described above.

Endcap Retaining Assembly

Figure 14:
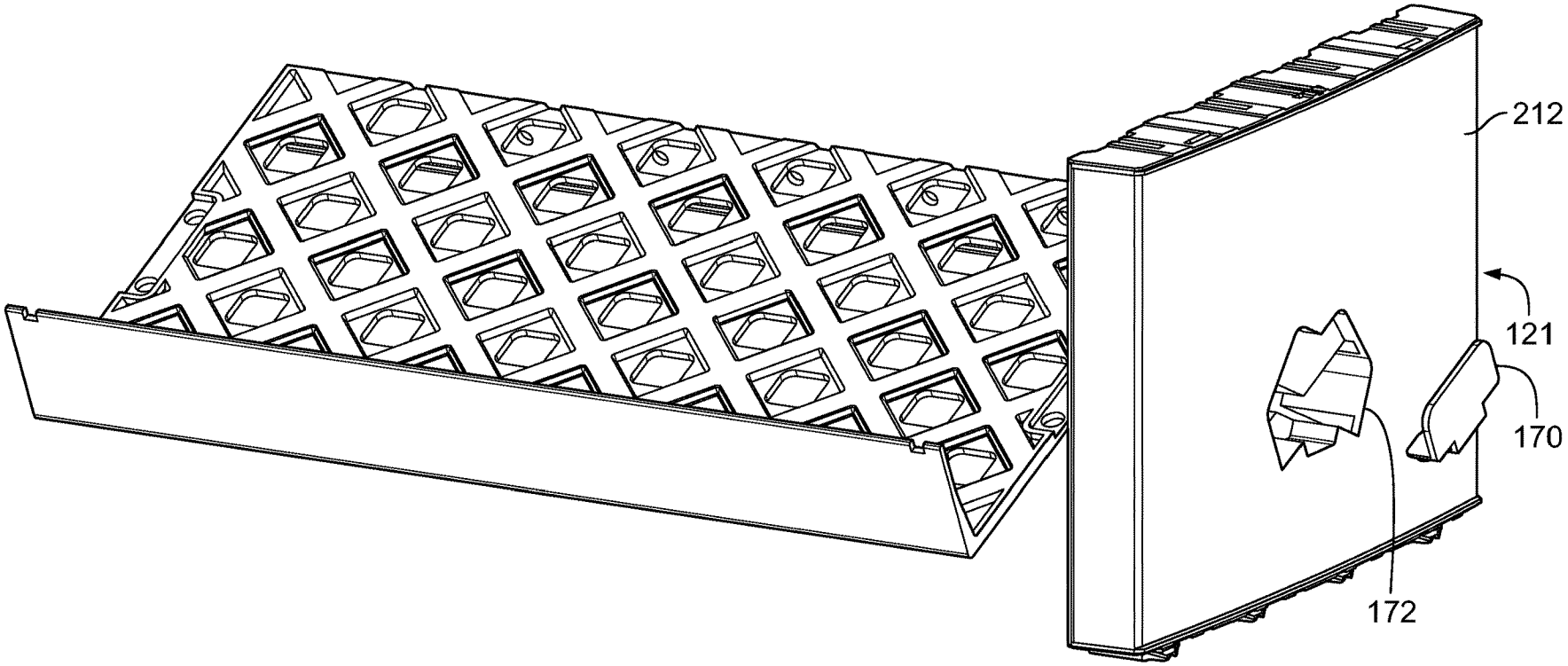
FIGS. 14-15 illustrate external and internal perspective views, respectively, of one example of a shelving display system having an endcap with a retaining assembly.
Figure 15:
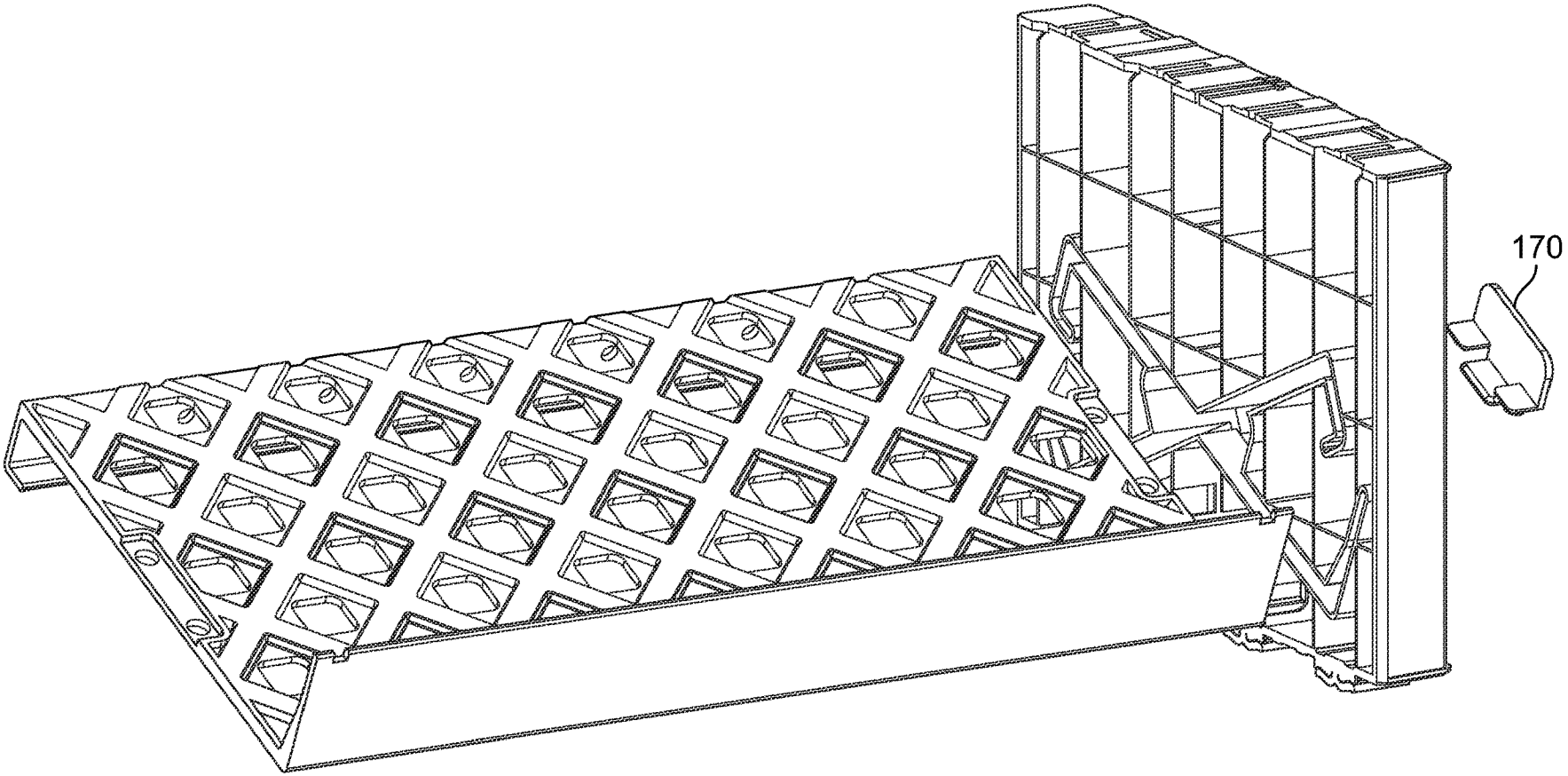

FIGS. 14-15 illustrate an example endcap retaining assembly 170 (although any other appropriate mechanism may be used). The retaining assembly (or clip) 170 may pass through a side opening 172 of the second face 212 of the first endcap 121 to engage the shelf. The retaining assembly may have an "L-shaped" or other appropriate cross-section such that it may hold and display bags, sachets, branded merchandise, and the like.

Hook Assembly

FIG. 16 illustrates a hook assembly 180. The hook assembly 180 may comprise a crossbar 182 and a plurality of hooks 184 attached to the crossbar 182. The hooks may have a flat portion 186 and one or more arms 188. The crossbar 182 may engage with one or more endcaps. For example, an internal face of an endcap may have a slot sized to slideably engage the crossbar 182.

The hook assembly may be used to hold and/or display bags, sachets, branded merchandise, and the like. The hooks 184 may vary in size and shape, depending on the size, weight, shape, and other features of the bags, sachets, branded merchandise, etc.

Materials

The shelving display 100 may be manufactured from any appropriate material. For example, the endcaps, shelves, and other components may be constructed from a polymer such as polypropylene, polyethylene, polyamide, polyamide-6, polyamide-6 with fiber, or another plastic. In another example, components may be constructed from metal such as aluminum, stainless steel, or other appropriate metal.

Components may be manufactured using any appropriate technology, including 3D-printing, injection molding, and any other conventional machining methods.

Endcap Assembly

The shelving display 100 may be assembled via many methods. In one example: (1) a user aligns the first end portion 114 of the first shelf 111 with the first slanted portion 231 of the first slot recess 241 on the first face 211 of the first endcap 121; (2) the user inserts the first end portion 114 of the first shelf 111 into the first slanted portion 231 of the first slot recess 241; (3) the user aligns the second end portion 115 of the first shelf 111 with the sixth slanted portion 234 of the second slot recess 242 on the fifth face 215 of the second endcap 122; (4) the user inserts the second end portion 115 of the first shelf 111 into the sixth slanted portion 234 of the second slot recess 242; (5) the user aligns the first protrusion 301 on the first endcap 121 with the third groove 313 on the third endcap 123, the first protrusion 301 being complementary in shape to the third groove 313, and where the first protrusion 301 includes a first tongue 321 and a second tongue 322; (6) the user inserts the first and second tongues 321 and 322, respectively, into the third groove 313 of the third endcap 123, wherein during this insertion step the first and second tongues 321 and 322, respectively, deflect from a resting configuration to an assembled configuration as a portion of the third endcap 123 slides between the first and second tongues 321 and 322, respectively, and the third face 213 of the first endcap 121.

In another example, the step of aligning the first protrusion 301 and the third groove 313 further comprises the user aligning the first depression 331 on the third face 213 of the first endcap 121 from which the first protrusion 301 extends, with a rail (substantially identical to the first rail 351) on the twelfth face 222 of the third endcap 123 in which the third groove 313 is set, wherein the first depression 331 is complementary in shape to the rail and is sized to slideably engage the rail.

In another example, the assembly further comprises advancing the first nub 361 on the third face of the first endcap 121 past the third nub 363 on the twelfth face 222 of the third endcap 123, wherein the first and third nubs 361 and 363, respectively, are constructed and dimensioned such that during the advancing step, both nubs deflect from a resting configuration to a deflected configuration as the first and second nubs (361 and 363) slide past one other to achieve an assembled state, and return to the resting configuration in the assembled state.

Additional Advantages

An advantage of having the support structures 200 built into the endcaps 120 is that products can be displayed on shelving without dedicated supporting structures (e.g., spine, wall attachments, backboard, etc.). The endcaps 120 which previously may have only been used for decorative finishing or aesthetics, may (as disclosed here) provide the support structure for the shelves 110, thereby eliminating the need for a dedicated supporting structure(s). This reduces the number of components, the weight of the merchandising unit, and costs (packaging, shipping, manufacturing, etc.). Furthermore, the reversibility of the endcaps 120 in some examples allow the same endcaps 120 to be used on either the left or right side. This interchangeability further simplifies assembly and may also reduce manufacturing costs by requiring fewer unique parts. This modular design may also reduce shipping costs since there will be more substantially identical parts.

Another advantage is the reversibility of the shelves 110. For example, the figures illustrate first shelf 111 engaged with the first slanted portion 231 (of first face 211 of first endcap 121) and sixth slanted portion 234 (of fifth face 215 of second endcap 122). This provides a positive shelf angle 230. However, the first shelf 111 could be reversed, and thus, engaged with the second slanted portion 232 (of first face 211) and fifth slanted portion 233 (of fifth face 215), thereby providing a negative shelf angle 230. One feature that enables this reversibility is illustrated in the example of FIG. 2, where the first slanted portion 231 and second slanted portion 232 may be symmetrical about a vertical axis 240. The positive and negative shelf angles (each of which may be of the same or different magnitude as the other) may be any appropriate angle, such as an angle between about 0° to 90°, 0° to 45°, 0° to 30°, 30° to 45°, 30° to 60°, 45° to 90°, or 45° to 60°. In some embodiments, the angle is about 45°. In other embodiments, the angle is about 30°.

The modular nature of the base 150 allows the same shelving display 100 to be attached to a countertop via holes 152 in feet 151 (e.g., screws through holes). In another example, the shelving display 100 may rest on the base 150 with or without double sided tape. In another example, the base 150 may be removed so the shelving display 100 is free-standing.

Another advantage is the possible surfaces for promoting branded content. Each endcap 120 has an exterior major surface (e.g., second face 212, sixth face 216, tenth face 220, etc.) that can display advertisements, branded images, logos, and the like. The header display 140 may similarly display advertisements, branded images, logos, and the like. In some examples, the lighting source may be an LED display, further increasing the options for displaying branded content (e.g., changing images, videos, interactive content/menus, games, etc.).

Another advantage is the inter-groove spacing "X" and the distance from the end of the endcap to the nearest protrusion or groove of about "X/2". This allows versatility in how the endcaps can stack upon one another. The figures illustrate a staircase configuration (FIG. 11) and a pyramid configuration (FIG. 12), but others are possible. The pyramid configuration of FIG. 12 may be further built up by adding rows or three endcaps 120 and/or four endcaps to the bottom of the pyramid. Likewise, the staircase configuration can be similarly built up by adding endcaps 120. Any appropriate number of endcaps 120 may be stacked upon one another. Likewise, any appropriate number of shelves may be used in a given example.

While various embodiments of the invention have been described, the invention is not to be restricted except in light of the attached claims and their equivalents. These concepts may be applicable to other components within displays, shelving, retail displays, hooks, stacked shelving, support structures and the like. Moreover, the advantages described herein are not necessarily the only advantages of the invention and it is not necessarily expected that every embodiment of the invention will achieve all of the advantages described.

The invention claimed is:

1. A shelving display system, comprising:

a first shelf having a first end portion and a second end portion, wherein the first and second end portions are on opposite ends of the first shelf;

a first endcap having a first face, a second face, a third face, and a fourth face, wherein the first face is on an opposite side of the first endcap from the second face, and the third face is on an opposite side of the first endcap from the fourth face, wherein the first face includes a first support structure comprising a first slot recess, wherein the first end portion of the first shelf is configured to slideably engage and be inserted within the first slot recess, and wherein the first slot recess comprises a center, a first slanted portion and a second slanted portion each inclined upwardly from the center, a third slanted portion and a fourth slanted portion each inclined downwardly from the center respectively, wherein the first slanted portion is symmetrical to the second slanted portion about a vertical axis, and the third slanted portion is symmetrical to the fourth slanted portion about the vertical axis, a second endcap having a fifth face, a sixth face, a seventh face, and an eighth face, wherein the fifth face is on an opposite side of the second endcap from the sixth face, and the seventh face is on an opposite side of the second endcap from the eighth face, wherein the fifth face includes a second support structure comprising a second slot recess, wherein the second end portion of the first shelf is configured to slideably engage and be inserted within the second slot recess, wherein the second slot recess is substantially identical to the first slot recess, wherein the second slot recess comprises a fifth slanted portion substantially identical to the first slanted portion, a sixth slanted portion substantially identical to the second slanted portion, and at least one of a seventh slanted portion and an eighth slanted portion substantially identical to the at least one of a third slanted portion and a fourth slanted portion respectively, wherein the fifth slanted portion is symmetrical to the sixth slanted portion about a vertical axis, and wherein the first end portion is configured to be inserted within and slideably engageable with either the first slanted portion or the second slanted portion, wherein the second end portion is configured to be inserted within and slideably engageable with either the fifth slanted portion or the sixth slanted portion.

2. The shelving display system of claim 1, wherein the third face includes a first protrusion, wherein the fourth face includes a first groove complementary to the first protrusion and sized to slideably engage a third protrusion of a third endcap, where the third protrusion is substantially identical to the first protrusion, wherein the seventh face includes a second protrusion substantially identical to the first protrusion, and wherein the eighth face includes a second groove substantially identical to the first groove.

3. The shelving display system of claim 2, further comprising a first header and a second header attached to the first endcap and second endcap, respectively, wherein the first header includes a first structure engaged with one of the first protrusion or first groove, and the second header includes a second structure engaged with one of the second protrusion or the second groove.

4. The shelving display system of claim 3, further comprising a light source attached to at least one of the headers or endcaps, wherein wires providing power to the light source are at least partially hidden within at least one of the endcaps.

5. The shelving display system of claim 2, wherein the first groove extends through a surface of at least one of the first or second faces, wherein the first groove includes a first width W1 at the surface of the fourth face, and a second width W2 greater than the first width W1 in an interior of the first groove, wherein the first protrusion has a third width W3 at the surface of the third face, wherein the first protrusion has a fourth width W4 greater than the third width W3 at a distance away from the third face, and wherein the third width W3 is less than or equal to the first width W1, and the fourth width W4 is less than or equal to the second width W2.

6. The shelving display system of claim 5, further comprising a third endcap having a third groove substantially identical to the first groove of the first endcap, wherein a portion of the first protrusion having the fourth width W4 greater than the third width W3 comprises a first tongue, and wherein the first tongue is constructed and dimensioned such that during an assembly step when the first protrusion is advanced through the third groove, the first tongue deflects from a resting configuration to an assembled configuration as a portion of the third endcap slides between the first tongue and the third face.

7. The shelving display system of claim 6, wherein the portion of the first protrusion having the fourth width W4 greater than the third width W3 further comprises a second tongue, and wherein the second tongue is constructed and dimensioned such that during an assembly step when the first protrusion is advanced through the third groove, the second tongue deflects from a resting configuration to an assembled configuration as a portion of the third endcap slides between the second tongue and the third face.

8. The shelving display system of claim 2, wherein the first protrusion protrudes from a base of a first depression on the third face, wherein the first groove is set in a surface of a first rail, and wherein the first depression is complementary in shape to the first rail and is sized to slideably engage the first rail.

9. The shelving display system of claim 1, further comprising an interlocking mechanism having a first nub on the third face and a second nub on the fourth face.

10. The shelving display system of claim 9, further comprising a third endcap having a third nub substantially identical to the second nub wherein the first nub is constructed and dimensioned such that during an assembly step when the third nub is advanced past the first nub, both the first and third nubs deflect from a resting configuration to a deflected configuration as the first and third nubs slide past each other to achieve an assembled state, and wherein both the first and third nubs return to the resting configuration in the assembled state.

11. The shelving display system of claim 1, further comprising a third endcap substantially identical to the first endcap and engaged with the first endcap, wherein the first and third endcaps are offset from one another.

12. A shelving display system, including at least one unit, each unit comprising:

a first shelf having first and second ends;

first and second endcaps, each including an inward facing surface removably engageable with the respective first and second ends, wherein the first and second endcaps each include at least one protrusion on one of a top surface or a bottom surface of each of the endcaps, wherein the first and second endcaps each include at least one groove on a corresponding opposite side of each corresponding endcap from the at least one protrusion of each corresponding endcap, wherein the grooves are complementary in shape to the protrusions and sized to slideably engage substantially identical protrusions on other endcaps, wherein each groove extends through to one of the inward facing surface or an outward facing surface on an opposite side of each endcap from the inward facing surface of each endcap respectively, wherein each groove includes a first width W1 at the exterior of each groove, and a second width W2 greater than the first width W1 in an interior of each groove respectively, wherein each protrusion includes a third width W3 at the respective inwardly facing surface or outward facing surface of each endcap respectively, wherein each protrusion includes a fourth width W4 greater than the third width W3 at a distance away from the respective inwardly facing surface or outward facing surface of each endcap respectively, and wherein the third width W3 is less than or equal to the first width W1, and the fourth width W4 is less than or equal to the second width W2.

13. The shelving display system of claim 12, wherein the at least one unit comprises a plurality of units, wherein each unit engages a corresponding adjacent unit wherein portions of the protrusions having the fourth width W4 greater than the third width W3, on each of the units, comprises first and second tongues constructed and dimensioned such that when the protrusions of a first unit are advanced through the complementary grooves of a second unit, the first and second tongues deflect from a resting configuration to an assembled configuration as a portion of the second unit slides between the tongues of the first unit.

14. The shelving display system of claim 13,
wherein the protrusions each protrude from bases of depressions on the respective endcaps,
wherein the grooves are each set in surfaces of rails on the respective endcaps,
wherein the depressions are complementary in shape to the rails and are sized to slideably engage the rails, and
wherein the depressions of the first unit are aligned with the rails of the second unit.

15. The shelving display of claim 13,
wherein the top and bottom surfaces of the endcaps of the plurality of units each has at least one nub,
wherein the nubs are constructed and dimensioned such that nubs on the first unit are advanced past nubs on the second unit, and both nubs deflect from a resting configuration to a deflected configuration as the nubs slide past one other to achieve an assembled state, and
wherein the nubs are configured to return to the resting configuration in the assembled state.

16. The shelving display system of claim 12, wherein the at least one unit comprises a plurality of units,
wherein each unit engages an adjacent unit,
wherein the inward facing surfaces of the endcaps of the units each include a support structure including a slot recess comprising
a first slanted portion engaged with one of the first or second ends of the shelf of the respective unit, and
a second slanted portion symmetrical to the first slanted portion about a vertical axis.

17. An endcap for a shelving display, comprising:
a first face, a second face, a third face, and a fourth face,
wherein the endcap is a first endcap,
wherein the first face is on an opposite side of the first endcap from the second face, and the third face is on an opposite side of the first endcap from the fourth face,
wherein the first face includes a first slot recess comprising a center, a first slanted portion and a second slanted portion each inclined upwardly from the center, a third slanted portion and a fourth slanted portion each inclined downwardly from the center respectively, wherein the second slanted portion is symmetrical to the first slanted portion about a vertical axis, and the third slanted portion is symmetrical to the fourth slanted portion about the vertical axis,
wherein a first end portion of a shelf is slideably engageable to either the first slanted portion or the second slanted portion,
wherein the third face includes a first protrusion,
wherein the fourth face includes a first groove complementary to the first protrusion and sized to slideably engage a second protrusion on a second endcap, where the second protrusion is substantially identical to the first protrusion, and
wherein the first endcap is substantially symmetrical about a vertical axis.

18. The endcap of claim 17,
wherein the first protrusion protrudes from a base of a first depression on the third face,
wherein the first groove is set in a surface of a first rail on the fourth face, and
wherein the first depression is complementary in shape to the first rail and is sized to slideably engage a second rail on a second endcap that is substantially identical to the first rail.

19. The endcap of claim 17, further comprising an interlocking mechanism having a first nub on the third face and a second nub on the fourth face.

20. A shelving display system, comprising:
a first shelf having a first end portion and a second end portion, wherein the first and second end portions are on opposite ends of the first shelf;
a first endcap having a first face, a second face, a third face, and a fourth face,
wherein the first face is on an opposite side of the first endcap from the second face, and the third face is on an opposite side of the first endcap from the fourth face,
wherein the first face includes a first support structure comprising a first slot recess, and
wherein the first slot recess includes a first slanted portion, wherein the first end portion of the first shelf is configured to slideably engage and be inserted within the first slot recess,
a second endcap having a fifth face, a sixth face, a seventh face, and an eighth face,
wherein the fifth face is on an opposite side of the second endcap from the sixth face, and the seventh face is on an opposite side of the second endcap from the eighth face,
wherein the fifth face includes a second support structure comprising a second slot recess,
wherein the second slot recess is substantially identical to the first slot recess, and comprises a second slanted portion substantially identical to the first slanted portion, and
wherein the second end portion of the first shelf is configured to slideably engage and be inserted within the second slot recess,
wherein the third face includes a first protrusion,
wherein the fourth face includes a first groove complementary to the first protrusion and sized to slideably engage a third protrusion of a third endcap, where the third protrusion is substantially identical to the first protrusion,
wherein the seventh face includes a second protrusion substantially identical to the first protrusion,
wherein the eighth face includes a second groove substantially identical to the first groove,
wherein the first groove extends through a surface of at least one of the first or second faces,
wherein the first groove includes a first width W1 at the surface of the fourth face, and a second width W2 greater than the first width W1 in an interior of the first groove,
wherein the first protrusion has a third width W3 at the surface of the third face,
wherein the first protrusion has a fourth width W4 greater than the third width W3 at a distance away from the third face, and
wherein the third width W3 is less than or equal to the first width W1, and the fourth width W4 is less than or equal to the second width W2.

21. The shelving display system of claim 20, further comprising a third endcap having a third groove substantially identical to the first groove of the first endcap,
wherein the portion of the first protrusion having the fourth width W4 greater than the third width W3 comprises a first tongue, and wherein the first tongue is constructed and dimensioned such that during an assembly step when the first protrusion is advanced through the third groove, the first tongue deflects from a resting configuration to an assembled configuration as a portion of the third endcap slides between the first tongue and the third face.

22. The shelving display system of claim 21, wherein the portion of the first protrusion having the fourth width W4 greater than the third width W3 further comprises a second tongue, and wherein the second tongue is constructed and dimensioned such that during an assembly step when the first protrusion is advanced through the third groove, the second tongue deflects from a resting configuration to an assembled configuration as a portion of the third endcap slides between the second tongue and the third face.

23. The shelving display system of claim 20, wherein the first protrusion protrudes from a base of a first depression on the third face, wherein the first groove is set in a surface of a first rail, and wherein the first depression is complementary in shape to the first rail and is sized to slideably engage the first rail.

24. An endcap for a shelving display, comprising:

a first face, a second face, a third face, and a fourth face, wherein the endcap is a first endcap, wherein the first face is on an opposite side of the first endcap from the second face, and the third face is on an opposite side of the first endcap from the fourth face, wherein the first face includes a first slot recess, wherein the third face includes a first protrusion, wherein the fourth face includes a first groove complementary to the first protrusion and sized to slideably engage a second protrusion on a second endcap, where the second protrusion is substantially identical to the first protrusion, and wherein the endcap is substantially symmetrical about a vertical axis, wherein the first protrusion protrudes from a base of a first depression on the third face, wherein the first groove is set in a surface of a first rail on the fourth face, and wherein the first depression is complementary in shape to the first rail and is sized to slideably engage a second rail on a second endcap that is substantially identical to the first rail.

* * * * *